US009206636B2

(12) United States Patent
Nagl et al.

(10) Patent No.: US 9,206,636 B2
(45) Date of Patent: Dec. 8, 2015

(54) CLOSING HINGE

(75) Inventors: Wolfgang Nagl, Allersberg (DE); Florian Stephan, Herzogenaurach (DE); Herbert Müller, Nürnberg (DE); Helga Müller, legal representative, Nürnberg (DE)

(73) Assignee: SUSPA GMBH, Altdorf (DE)

( * ) Notice: Subject to any disclaimer, the term of this patent is extended or adjusted under 35 U.S.C. 154(b) by 0 days.

(21) Appl. No.: 14/111,233

(22) PCT Filed: Apr. 4, 2012

(86) PCT No.: PCT/EP2012/056184

§ 371 (c)(1),
(2), (4) Date: Oct. 11, 2013

(87) PCT Pub. No.: WO2012/139954

PCT Pub. Date: Oct. 18, 2012

(65) Prior Publication Data

US 2014/0068894 A1 Mar. 13, 2014

(30) Foreign Application Priority Data

Apr. 14, 2011 (DE) ..... 10 2011 007 400

(51) Int. Cl.
*E05F 3/22* (2006.01)
*E05F 1/14* (2006.01)
(Continued)

(52) U.S. Cl.
CPC ..... *E05F 1/1207* (2013.01); *E05F 1/1215* (2013.01); *E05F 3/20* (2013.01); *E05Y 2900/132* (2013.01); *Y10T 16/53888* (2015.01)

(58) Field of Classification Search
CPC ..... E05Y 2201/20; E05Y 2201/21; E05Y 2201/212; E05Y 2201/214; E05Y 2201/216; E05Y 2201/25; E05Y 2201/256; E05Y 2201/236; E05F 3/00; E05F 3/04; E05F 3/20; E05F 5/02; E05F 5/027; E05F 5/10; E05F 1/1207; E05F 1/1215; E05F 1/1223; E05F 1/1008
USPC ..... 16/50, 54, 68, 58, 71, 78, 80, 49, 51, 16/318, 319, 280, 281, 310, 316, 317; 188/276, 277, 278, 283, 290, 293
See application file for complete search history.

(56) References Cited

U.S. PATENT DOCUMENTS 2,127,327 A * 8/1938 De Millar ..... 16/54
2,164,358 A * 7/1939 Stannard ..... 16/54
(Continued)

FOREIGN PATENT DOCUMENTS

GB 2420587 A * 5/2006
WO 2008/100035 A1 8/2008
(Continued)

*Primary Examiner* — Chuck Mah
(74) *Attorney, Agent, or Firm* — McGlew and Tuttle, P.C.

(57) ABSTRACT

A closing hinge for the pivotable articulation of a first part, in particular a door leaf, on a second part, in particular a door frame, includes a center longitudinal axis, a rotating receiver unit that can be rotated about the center longitudinal axis for fastening to the first part, which can be rotated, in particular, about the center longitudinal axis, and a freely rotating closing unit, which is connected to the rotating receiver unit in a torque-transmitting manner, for fastening to the second part, which is fixed, in particular, with respect to the center longitudinal axis, the closing hinge being displaceable between a closing arrangement and a freely rotating arrangement, the rotating receiver unit being freely rotatable, in particular in a torque-free manner, about the center longitudinal axis relative to the freely rotating closing unit in the closing arrangement.

29 Claims, 36 Drawing Sheets

(51) Int. Cl.
*E05F 1/12* (2006.01)
*E05F 3/20* (2006.01)

(56) References Cited

U.S. PATENT DOCUMENTS 2,434,524 A * 1/1948 Swanson ..... 16/54
2,456,537 A * 12/1948 Seaman et al. ..... 16/54
2,591,476 A * 4/1952 Swanson ..... 16/54
4,068,344 A * 1/1978 Okabe ..... 16/54
4,103,392 A * 8/1978 MacDonald ..... 16/54
4,155,144 A * 5/1979 Koganei ..... 16/54
4,325,164 A * 4/1982 Sasaki ..... 16/55
4,485,522 A * 12/1984 Chen ..... 16/54
5,152,029 A * 10/1992 Pai ..... 16/54
6,658,694 B2 * 12/2003 Wang ..... 16/50
6,854,161 B2 * 2/2005 Lee ..... 16/50
2004/0068833 A1 * 4/2004 Sawa ..... 16/60
2004/0250377 A1 * 12/2004 Park ..... 16/50
2007/0089273 A1 * 4/2007 Kang ..... 16/330
2009/0241289 A1 * 10/2009 Choi et al. ..... 16/275
2010/0319260 A1 * 12/2010 Sawa ..... 49/326
2011/0072618 A1 3/2011 Chen
2012/0233810 A1 * 9/2012 Salutzki et al. ..... 16/52

FOREIGN PATENT DOCUMENTS

WO 2009/123381 A1 10/2009
WO 2011/006477 A1 1/2011

* cited by examiner

CLOSING HINGE

CROSS-REFERENCE TO RELATED APPLICATIONS

This application is a United States National Phase Application of International Application PCT/EP2012/056184 filed Apr. 4, 2012 and claims the benefit of priority under 35 U.S.C. §119 of German Patent Application DE 10 2011 007 400.7 filed Apr. 14, 2011, the entire contents of which are incorporated herein by reference.

FIELD OF THE INVENTION

The invention relates to a closing hinge for the pivotable articulation of a first part, in particular a door leaf, on a second part, in particular a door frame.

BACKGROUND OF THE INVENTION

A door arrangement with a closing device, which, for example has a gear drive with a slide rail, which are in each case arranged on an upper side of a door leaf and a door frame, is known from public prior use. A closing system of this type is laborious to produce and impairs the appearance of a door arrangement of this type. The handling of the door arrangement is impaired, as the closing system projects into the opening region of the door.

SUMMARY OF THE INVENTION

The invention is based on an object of improving a closing hinge for the pivotable articulation of a first part on a second part.

The object is achieved by a closing hinge for the pivotable articulation of a first part, in particular a door leaf, on a second part, in particular a door frame, wherein the closing hinge comprises a center longitudinal axis, a rotating receiver unit that is rotatable about the center longitudinal axis for fastening to the first part that is rotatable, in particular, about the center longitudinal axis, and a freely rotating closing unit, which is connected to the rotating receiver unit in a torque-transmitting manner, for fastening to the second part, which is fixed, in particular with respect to the center longitudinal axis, wherein the closing hinge is displaceable between a closing arrangement and a freely rotating arrangement, wherein, in the closing arrangement, the freely rotating closing unit brings about a closing torque on the rotating receiver unit in a closing rotational direction about the center longitudinal axis, and wherein, in the freely rotating arrangement, the rotating receiver unit is freely rotatable, in particular in a torque-free manner, relative to the freely rotating closing unit about the center longitudinal axis.

The core of the invention is to provide a closing hinge with a rotating receiver unit, which can be rotated about a center longitudinal axis and is used for fastening to a first part, in particular a door leaf, the rotating receiver unit being connected in a torque-transmitting manner to a freely rotating closing unit, which is used for fastening on a second part, in particular a door frame.

In this case, the closing hinge can be displaced between a closing arrangement and a freely rotating arrangement, the freely rotating closing unit bringing about a closing torque on the rotating receiver unit in a closing rotational direction about the center longitudinal axis in the closing arrangement. Accordingly, in the freely rotating arrangement, the rotating receiver unit can be rotated freely and, in particular, in a torque-free manner, in relation to the freely rotating closing unit about the center longitudinal axis.

The closing hinge, because of the arrangement of the rotating receiver unit and the freely rotating closing unit concentrically with respect to the center longitudinal axis, allows a compact arrangement of the components in a closing hinge. Moreover, the closing hinge allows the rotating receiver unit to be coupled or decoupled to/from the freely rotating closing unit. It is therefore possible to deactivate the closing function of the closing hinge, in particular at large pivoting angles, during a pivoting of the first part in relation to the second part.

A closing hinge, in which the rotating receiver unit has a rotating receiver element for torque-transmitting connection to the freely rotating closing unit, is robust in configuration. The use of a rotating receiver element allows direct and economical transmission of a torque.

A closing hinge, in which the freely rotating closing unit has a rotating drive element non-rotatably connected to the rotating receiver unit with respect to the center longitudinal axis, allows direct transmission of the torque from the rotating receiver unit to a rotating drive element of the freely rotating closing unit.

A closing hinge, in which the freely rotating closing unit has a tensioning unit for applying the closing torque to the rotating receiver unit, allows the integration of a tensioning function in the freely rotating closing unit. A tensioning unit provided for this may be integrated in the freely rotating closing unit.

A closing hinge, comprising a coupling element for connecting the rotating drive element to the tensioning unit in a torque-transmitting manner or freely rotatably, in particular in a torque-free manner, about the center longitudinal axis, selectively allows a connection of the rotating drive element to the tensioning unit, either in a torque-transmitting manner or in a freely rotatable arrangement, a rotation about the center longitudinal axis taking place in a torque-free manner, in particular in the freely rotatable arrangement, i.e. in the freely rotating arrangement.

A closing hinge, in which the coupling element and the tensioning element are arranged non-rotatably with respect to the center longitudinal axis and axially displaceably with respect to one another, in particular by means of a profile guide having a non-round cross-sectional profile perpendicular to the center longitudinal axis, allows a tensioning of the tensioning unit by means of the coupling element. Since the coupling element is axially displaceably arranged along the center longitudinal axis, the coupling between the rotating drive element and the tensioning element can take place in a particularly uncomplicated and effective manner. For torque transmission, the coupling element is connected to the tensioning unit, in particular by a profile guide having a non-round cross-sectional profile perpendicular to the center longitudinal axis.

A closing hinge, wherein the coupling element and the rotating receiver element are non-rotatably arranged with respect to the center longitudinal axis and axially displaceably with respect to one another, in particular by corresponding end face profiles, allows a torque transmission from the coupling element to the rotating receiving element and, simultaneously, an axial displacement along the center longitudinal axis. This can advantageously take place by means of corresponding end face profiles of the coupling element and the rotating receiver element.

A closing hinge, in which the tensioning unit has a tensioning element, in particular a torsion spring, arranged between a base plate and a closing drive element that is rotatable about the center longitudinal axis, has a robust and mechanically highly stressable tensioning element, in particular a torsion spring, which can be tensioned or relieved of tension by a rotation of the tensioning unit about the center longitudinal axis. For this purpose, the tensioning element is advantageously fastened eccentrically on a closing drive element that can be rotated about the center longitudinal axis.

A closing hinge, comprising a parking element, which is non-rotatable with respect to the center longitudinal axis, to receive the closing torque in the freely rotating arrangement, in particular by a non-rotatable arrangement of the coupling element on the parking element, the parking element, in particular, being arranged coaxially with respect to the center longitudinal axis between the coupling element and the tensioning unit, allows the pretensioning of the tensioning unit to be preserved by a parking element that is arranged non-rotatably with respect of the center longitudinal axis. Accordingly, the parking element is suitable to receive the closing torque exerted by the tensioning unit. The parking element is advantageously arranged along the center longitudinal axis between the coupling element and the tensioning unit. A closing hinge, in which, in the freely rotating arrangement, in particular the coupling element is connected to the parking element in a torque-transmitting manner, allows a free rotation of the first part in relation to the second part in that a closing torque of the tensioning unit is decoupled from the rotating receiver element.

A closing hinge, in which the closing torque acting with respect to the center longitudinal axis is adjustable, can be individually adapted to a respective application task.

A closing hinge, in which a transition from the closing arrangement into the freely rotating arrangement is adjustable, in particular by fixing a closing angle about the center longitudinal axis of the rotating receiver unit relative to the freely rotating closing unit, allows a variable adjustment of a closing angle, which means an activation of the closing function of the closing hinge.

A closing hinge, comprising a closing hinge housing upper part, in which the rotating receiver unit is arranged, and comprising a closing hinge housing lower part, in which the freely rotating closing unit is arranged, and in which the closing hinge housing lower part and the closing hinge housing upper part are arranged concentrically with respect to the center longitudinal axis and are pivotable relative to one another about the latter, the closing hinge in particular being a hinge for fastening the closing hinge housing lower part to a door frame and the closing hinge housing upper part to a door leaf, has a particularly compact configuration. A closing hinge of this type is unelaborate in configuration and is, in particular, suitable to replace a hinge already used on a door arrangement. It is therefore possible to upgrade an already existing door arrangement by a closing hinge with a closing function.

A closing hinge, comprising a further freely rotating closing unit, has an improved closing characteristic. Since an additional freely rotating closing unit is provided, a further torsion spring can be activated connected during the opening or closing, in particular of a door. In particular it is possible to switch the second freely rotating closing unit separately from the first freely rotating closing unit. In particular, one of the two freely rotating closing units allows an activation of the second torsion spring in a small angle range, i.e. shortly before a door leaf rests on a door frame. It is thus advantageously possible to ensure reliable closing of the door and, in particular to apply an increased closing force due to overcoming a catch on the lock and a compression of a seal. At the same time it is ensured that when the door is opened, this increased closing force only has to be overcome in a small rotation angle range. In particular, this angle range is less than 10°, in particular less than 5° and in particular less than 2°. This opening angle range can, in particular, be adjusted.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
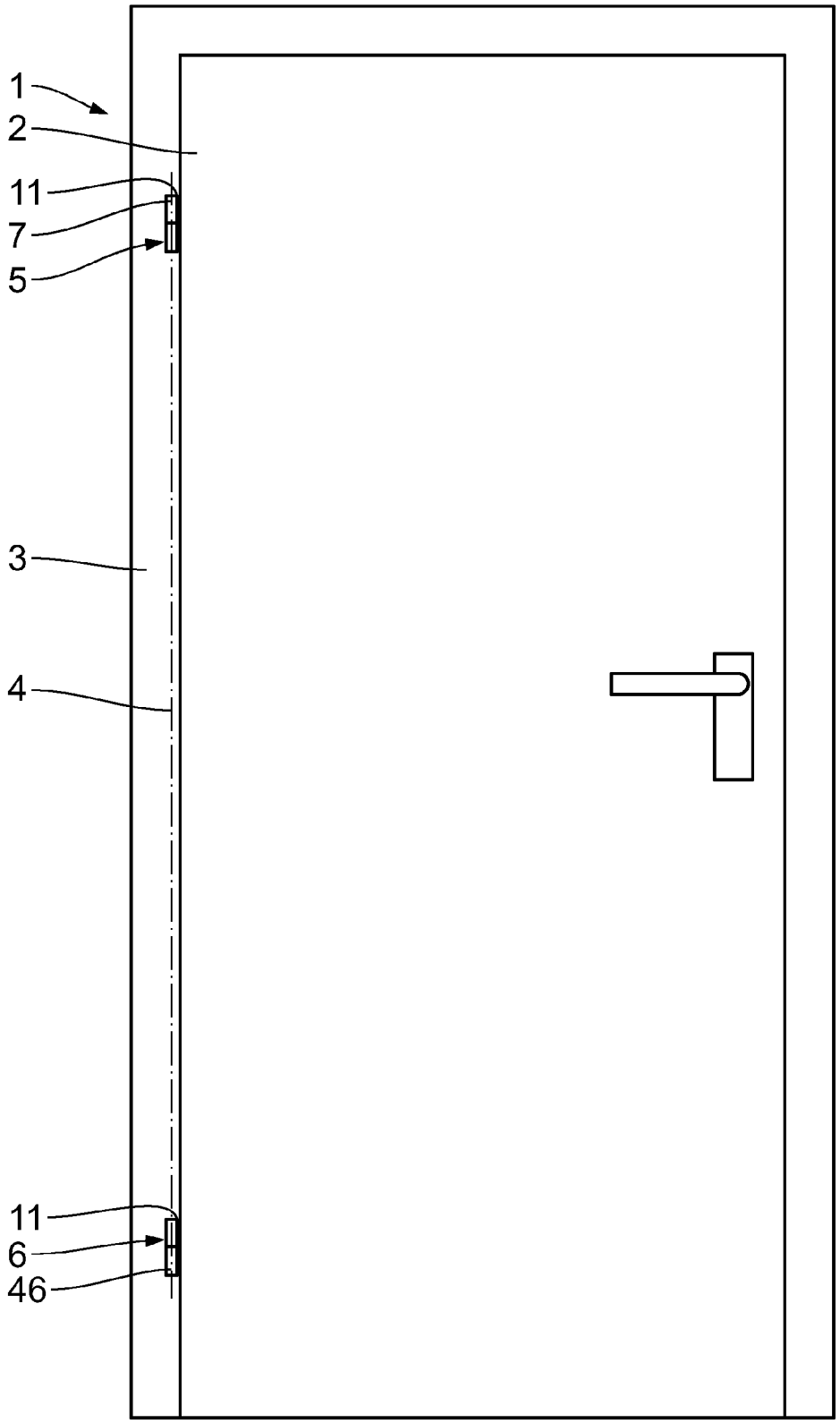
FIG. 1 is a schematic front view of a door arrangement.

A door arrangement 1 shown in FIG. 1 comprises a first part in the form of a door leaf 2 and a second part in the form of a door frame 3. The door leaf 2 is pivotably arranged or articulated on the door frame 3 about a pivot axis 4 running substantially vertically.

The door arrangement 1 furthermore comprises a closing hinge 5 connecting the door leaf 2 and the door frame 3 for a closing movement of the door leaf 2 in relation to the door frame 3. The closing hinge 5 is arranged in an upper region of the door arrangement 1. It is also possible for the closing hinge 5 to be arranged in a lower region on the door arrangement 1.

Furthermore, the door arrangement 1 has a damping hinge 6 arranged at the bottom for damping the closing movement. The damping hinge 6 connects the door leaf 2 to the door frame 3.

According to FIG. 1, the door arrangement 1 is arranged in a closed position, i.e. the door leaf 2 rests on the door frame 3 in a closing manner. A pivoting angle a of the pivotable door leaf 2 in relation to the fixed door frame 3 is 0° in the closed position of the door arrangement 1. By pivoting the door leaf 2 in relation to the door frame 3 about the pivot axis 4, the door leaf 2 is displaced in relation to the door frame 3 at a pivoting angle a that differs from zero. The door arrangement 1 is then in an opened position. In the opened position, the door arrangement 1 can be displaced with the closing hinge 5 between a closing arrangement, in which the closing hinge 5 brings about a closing torque in a closing direction of rotation, and a freely rotating arrangement, in which the closing hinge does not bring about a closing torque, so a torque-free displacement of the door leaf 2 about the pivot axis 4 is provided.

The door arrangement 1 shown in FIG. 1 can be used, for example, for interior doors and/or exterior doors in building construction. It is basically also possible to configure the door arrangement 1, for example, for furniture or functional appliances, such as, for example, a refrigerator and/or freezer, with a door or flap that can be pivoted about a vertically oriented pivot axis, as the first part 2. The second part 3, in this case, would be the body of a piece of furniture or a housing. Accordingly, it is also possible to provide the door arrangement 1 for a functional appliance with a pivot axis, which is arranged horizontally, about which a first part 2 can be pivoted in relation to a second part 3, such as, for example, a freezer chest.

The closing hinge 5 and the damping hinge 6 are, in each case, substantially cylindrical. The two hinges 5, 6 are in each case arranged concentrically with respect to the pivot axis 4 and spaced apart from one another. The combination of the use of the closing hinge 5 and the damping hinge 6 ensures, on the one hand, that the door leaf 2 has a closing function, i.e. is closed automatically, and, on the other hand, has a damping function, so an inadvertent slamming of the door is prevented by damping.

Figure 2:
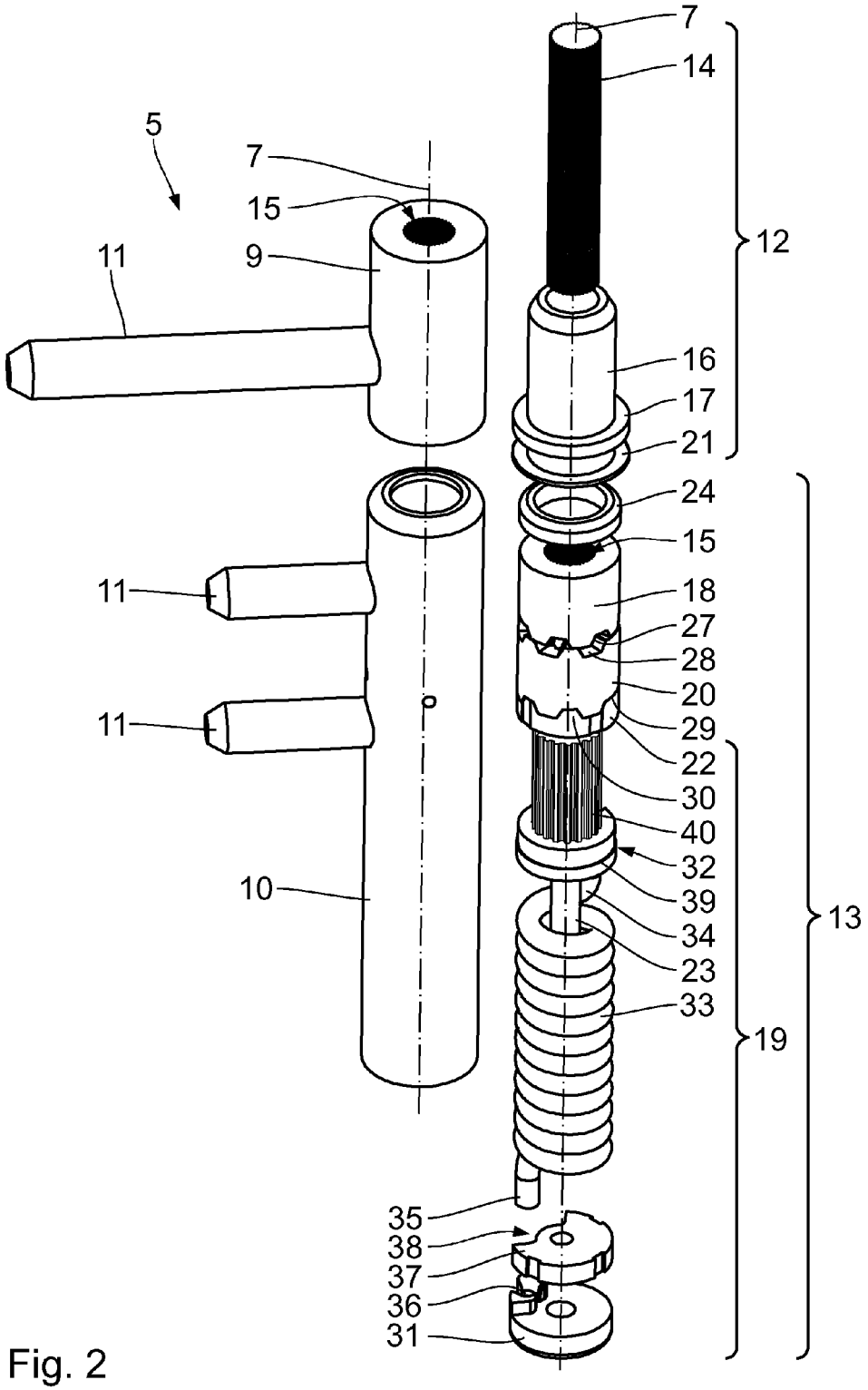
FIG. 2 is a prospective exploded view of a closing hinge according to the invention in accordance with a first embodiment of the door arrangement shown in FIG. 1.
Figure 3:
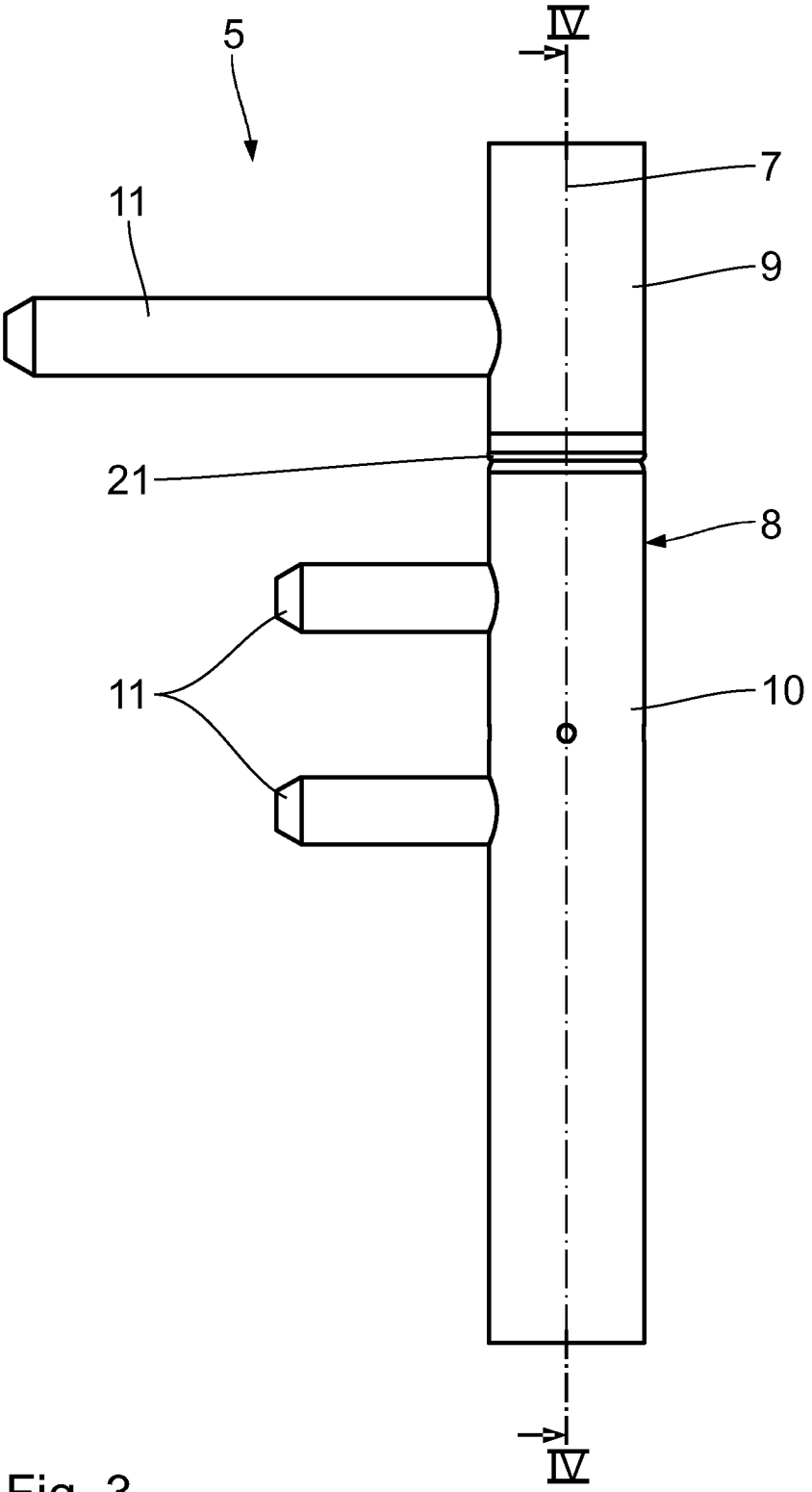
FIG. 3 is a side view of the closing hinge corresponding to FIG. 2.
Figure 4:
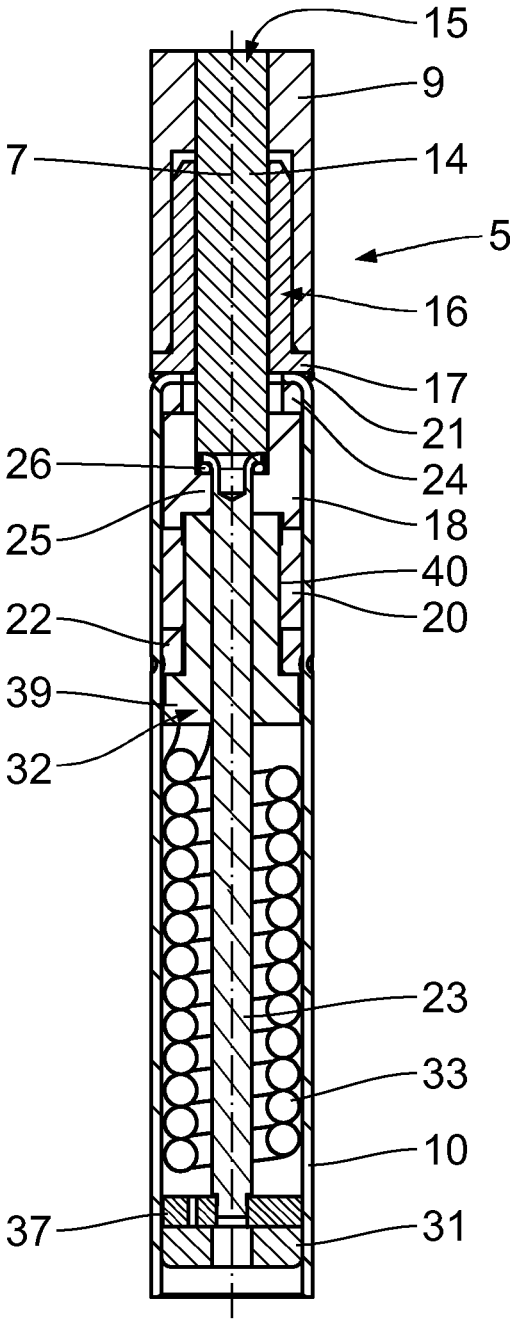
FIG. 4 is a longitudinal sectional view along the section line IV-IV in FIG. 3.

The closing hinge 5 will be described in more detail below with the aid of FIG. 2 to FIG. 4 in accordance with a first embodiment. The closing hinge 5 is used for the pivotable articulation of the door leaf 2 on the door frame 3. It has a center longitudinal axis 7, which, because of the concentric arrangement of the closing hinge 5 with respect to the pivot axis 4 is arranged concentrically with respect to the pivot axis 4 in the door arrangement 1. The closing hinge 5 furthermore has a substantially hollow cylindrical closing hinge housing 8 with a closing hinge housing upper part 9 and a closing hinge housing lower part 10. The closing hinge 5 is also called a band with a closing function. The housing parts 9, 10 of the band with the closing function can be rotated with respect to the center longitudinal axis 7 in relation to one another. The closing hinge 5 according to the first embodiment is configured as a two-part band. Fastening journals 11, which are used to fasten the closing hinge housing upper part 9 on the door leaf 2 or to fasten the closing hinge housing lower part 10 on the door frame 3, in each case extend from the housing parts 9, 10 perpendicular to the center longitudinal axis 7. The number, the length radially with respect to the center longitudinal axis as well as the diameter of the fastening journals 11 on the housing parts 9, 10 may vary depending on the door arrangement 1 and is adapted in accordance with the materials to be connected and/or the torque loads to be expected. The closing hinge housing 8 according to the embodiment shown has an external diameter of 16 mm and a length along the center longitudinal axis 7 of 125 mm.

The closing hinge 5 furthermore has a rotating receiver unit 12 that can be rotated about the center longitudinal axis 7.

Furthermore, the closing hinge 5 comprises a freely rotating closing unit 13, which is connected to the rotating receiver unit 12 in a torque-transmitting manner and is arranged in the closing hinge housing lower part 10. Accordingly, the freely rotating closing unit 13 is fastened to the door frame 3. The freely rotating closing unit 13 is fixed with respect to the center longitudinal axis 7. The rotating receiver unit 12 is arranged in the closing hinge housing upper part 9 and thus accordingly fastened to the door leaf 2. The rotating receiver unit 12 can be rotated about the center longitudinal axis 7.

The rotating receiver unit 12 comprises a rotating receiver element 14 in the form of a multi-tooth profile rod. The rotating receiver element 14 is used for the torque-transmitting section between the rotating receiver unit 12 and the freely rotating closing unit 13. The rotating receiver element 14 has a non-round cross-section oriented perpendicular to the center longitudinal axis 7 in the form of a multi-tooth profile. The multi-tooth profile has a plurality of teeth uniformly arranged along a periphery. The rotating receiver element 14 is arranged in a corresponding profile recess 15 provided for this in the closing hinge housing upper part 9. Upon a pivoting movement of the door leaf 2 about the pivot axis 4, this pivoting movement is transmitted by means of the upper fastening journal 11 associated with the door leaf 2 to the closing hinge housing upper part 9 and transmitted by means of the profile recess 15 onto the rotating receiver element 14, which is accordingly rotated about the center longitudinal axis 7. Since the rotating receiver element 14 is configured as a multi-tooth profile rod, each individual tooth having two tooth flanks tapering toward one another, a torque transmission is possible from the closing hinge housing upper part 9 to the torque receiver element 14 of the rotating receiver unit 12 and, vice versa, in both directions of rotation about the center longitudinal axis 7 or the pivot axis 4.

Furthermore, the rotating receiver unit 12 has a sliding sleeve 16, which has good sliding properties. The sliding sleeve 16 may, for example, be produced from brass or from plastics material. It is placed on the rotating receiver element 14 and has an internal diameter that is greater than a maximum external diameter of the rotating receiver element 14.

The profile recess 15 for torque transmission between the closing hinge housing upper part 9 and the rotating receiver upper part 14 extends only in portions along the center longitudinal axis 7. The sliding sleeve 16 is arranged within the closing hinge housing upper part 9. At a lower end remote from the profile recess 15, the sliding sleeve 16 has a radially protruding collar 17. The collar 17 is used as a bearing face for the closing hinge housing upper part 9.

The freely rotating closing unit 13 comprises a rotating drive element 18, a tensioning unit 19 and a coupling element 20 to connect the rotating drive element 18 to the tensioning unit 19. In the assembled state of the closing hinge 5 according to FIG. 4, the rotating receiver element 14 projects at least in portions into the closing hinge housing lower part 10, which is preferably configured as a thin-walled metal tube. On an upper side facing the closing hinge housing upper part 9, the closing hinge housing lower part 10 is rounded and has an end face oriented substantially perpendicular to the center longitudinal axis 7. A guide ring 21, which is produced, for example, from plastics material or brass and is arranged about the center longitudinal axis 7 between the closing hinge housing upper part 9 and the closing hinge housing lower part 10, rests on this end face.

The freely rotating closing unit 13 furthermore comprises a parking element 22.

The rotating drive element 18, the tensioning unit 19, the coupling element 20 and the parking element 22 are arranged coaxially with respect to the center longitudinal axis 7 and connected to one another by means of a rod 23 passing through the latter and also arranged coaxially with respect to the center longitudinal axis 7. The rotating receiver element 14, the rotating drive element 18, the tensioning unit 19, the coupling element 20 and the parking element 22 are also called a control mechanism. To axially fix the freely rotating closing unit 13 by means of the rod 23, the rotating drive element 18 has an interior shoulder 25, on which the rod 23 rests with a radially protruding rod head. According to the embodiment shown, an intermediate disc 26 is arranged between the shoulder 25 and the rod head.

The rotating receiver element 14 projects—as already mentioned—into the closing hinge housing lower part 10 in portions and is received in a profile recess 15, which is identical to the profile recess 15 of the closing hinge housing upper part 9. Accordingly, the rotating receiver unit 12 is non-rotatably connected to the freely rotating closing unit 13 with respect to the center longitudinal axis 7. Arranged on the upper side of the closing hinge housing lower part 10 is a spacer ring 24, which ensures a spaced-apart arrangement of the rotating drive element 18 from the upper side of the closing hinge housing lower part 10.

The coupling element 20 and the rotating drive element 18 are arranged in an adjacent manner along the center longitudinal axis 7. The rotating drive element 18 has, on a lower end face facing the coupling element 20, a rotating receiver end face profile 27, which cooperates with a first, corresponding, upper coupling end face profile 28 of the coupling element 20. The end face profiles 27, 28, along the periphery about the center longitudinal axis 7, have trapezoidal, end recesses 41, which, can in each case be brought into engagement with trapezoidal, end projections 42 of the respective other end face profile 27, 28. The end face profiles 27, 28 are matched to one another in such a way that when the trapezoidal projections 42 are arranged in the respective corresponding trapezoidal recesses 41, the rotating drive element 18 and the coupling element 20 form a closed lateral surface. In this arrangement, the coupling element 20 is minimally spaced apart from the rotating drive element 18 along the center longitudinal axis 7. The elements 18, 20 preferably rest directly on one another.

At an end face remote from the rotating drive element 18 and therefore facing the parking element 22, the coupling element 20 has a second coupling end face profile 29. The second coupling end face profile 29 corresponds with a parking end face profile 30 of the parking element 22. The end face profiles 29, 30 are also in the form of trapezoidal end recesses 41 or projections 42 arranged along a periphery about the center longitudinal axis 7. It is possible for the two coupling end face profiles 28, 29 to be identical, so the coupling element 20 can be produced in a simplified manner. The coupling element 20 is sleeve-like and has, at an inner side, triangular recesses arranged parallel to the center longitudinal axis 7.

The tensioning unit 19 has a tensioning element, which is arranged between a base plate 31 and a closing drive element 32 that is rotatable about the center longitudinal axis 7, in the form of a torsion spring 33. The parking element 22 is non-rotatably held in the closing hinge housing lower part 10. According to the embodiment shown, the non-rotatable arrangement of the parking element 22, takes place by means of spherical portion-like impressions from an outer side on the closing hinge housing lower part 10, which can be produced, for example, by a pin-like embossing tool. As a result, the parking element 22 is positively held on the closing hinge housing lower part 10. Four embossings are provided along the periphery of the housing lower part 10. Fewer impressions, but at least three, may be provided.

The torsion spring 33 winds around the rod 23 in the form of a helix and is rigidly connected by a first end 34 arranged eccentrically with respect to the center longitudinal axis 7 to the closing drive element 32. At a second end 35 opposing the first end 34, the torsion spring 33 is connected to the base plate 31 eccentrically with respect to the center longitudinal axis 7. For this purpose, the base plate 31 has a receptacle 36 arranged eccentrically with respect to the center longitudinal axis 7. Arranged on the base plate 31 is a control disc 37 with an elongate control recess 38, which cooperates with the receptacle 36 of the base plate 31 in such a way that a pretensioning of the torsion spring 33 held by the second end 35 in the receptacle 36 of the base plate 31 can be adjusted. On an outer cylindrical lateral surface, the control disc 37 has grooves, which are oriented parallel to the center longitudinal axis 7 and by means of which the control disc 37 is non-rotatably held with respect to the center longitudinal axis 7 in the closing hinge housing lower part 10. The base plate 31 and the control disc 37, at respective mutually facing end faces, have corresponding, mutually engaging tooth profiles, so the base plate 31 is non-rotatably held with respect to the center longitudinal axis 7 on the control disc 37. It is thereby possible to arrange the base plate 31 with the receptacle 36 rotated with respect to the center longitudinal axis 7 in various positions and to hold it on the control disc 37. As a result, the pretensioning of the torsion spring 33 can be changed.

The closing drive element 32 has a guide base 39, which rests in a guiding manner on an inner side of the closing hinge housing lower part 10. A profile guide 40, which has a non-round cross-sectional profile perpendicular to the center longitudinal axis 7 in the form of a multi-tooth profile, extends perpendicular to the guide base 39 along the center longitudinal axis 7. The profile guide 40 corresponds to the inner side of the coupling element 20. As a result, the coupling element 20 and the tensioning unit 19 are arranged non-rotatably with respect to the center longitudinal axis 7 and axially displaceably in relation to one another. The parking element 22 is annular, a central opening having an internal diameter such that the profile guide 40 of the closing drive element 32 can be guided without contact along the center longitudinal axis 7 through the parking element 22.

Figure 5:
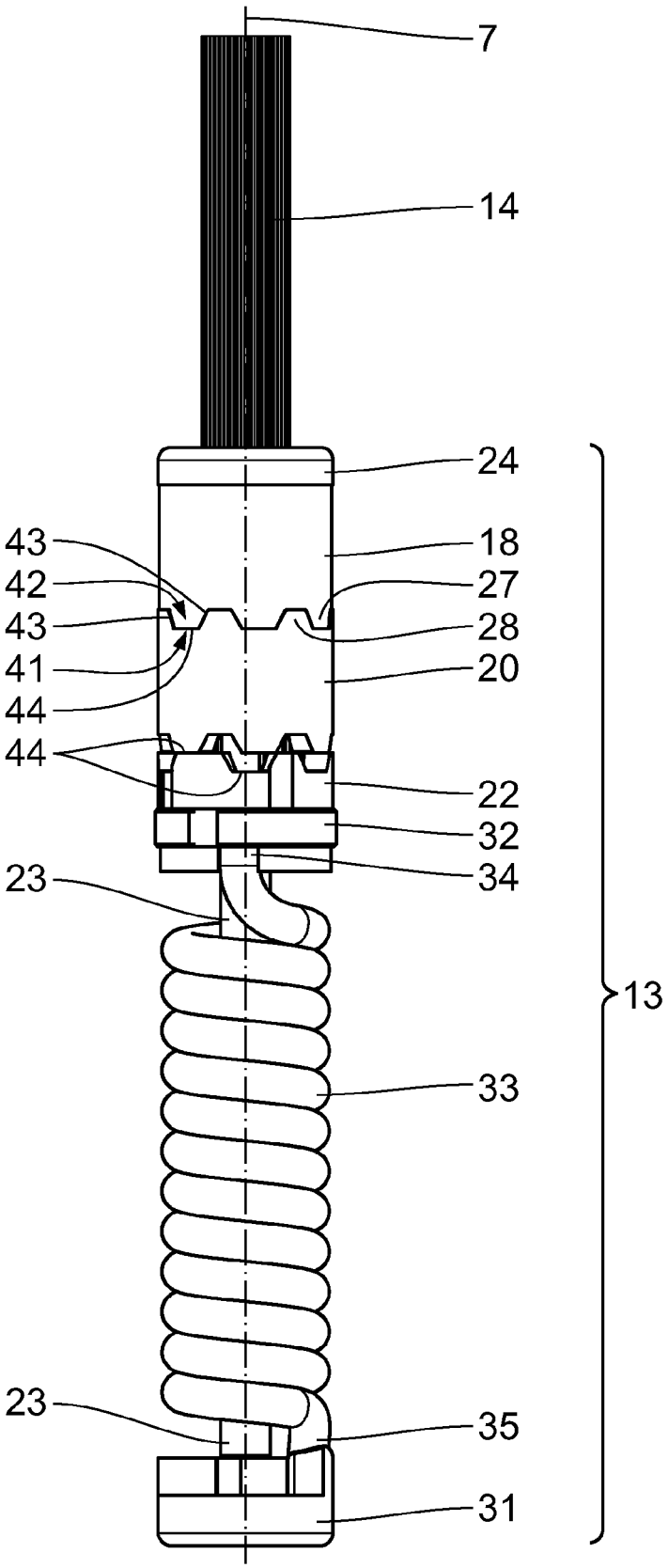
FIG. 5 is an enlarged side view, corresponding to FIG. 2, of a control mechanism of the closing hinge in a closing arrangement.

The mode of functioning of the closing hinge 5 will be shown in more detail below with the aid of FIGS. 2 to 7. FIG. 5 shows the closing hinge 5 partially, i.e. the rotating receiver element 14 of the rotating receiver unit 12 and the freely rotating closing unit 13, in a closed position of the door arrangement 1. In the closed position, the rotating drive element 18 with the rotating receiver end face profile 27 and the coupling element 20 with the first coupling end face profile 28 are arranged resting on one another. This means that the trapezoidal projections 42 of one end face profile positively engage, in each case, in the trapezoidal recesses 41 of the respective other end face profile.

Each trapezoidal recess 41 and each trapezoidal projection 42 in each case have two flanks 43 arranged obliquely with respect to the center longitudinal axis 7, tapering toward one another and connected to one another by a base 44 oriented perpendicular to the center longitudinal axis 7. It is also possible for the base 44 to not be arranged perpendicularly, but obliquely with respect to the center longitudinal axis 7. It is also possible for the end face profiles 27 to 30 to have recesses and shapes formed differently, which mutually engage. However, it is necessary for the end face profiles 27 to 30 to allow the components 18, 20 and 20, 22 connected thereto to be arranged, on the one hand, non-rotatably with respect to the center longitudinal axis 7, i.e. in a torque-transmitting manner, and, on the other hand, to be arranged axially displaceably with respect to one another along the center longitudinal axis 7.

In the arrangement shown in FIG. 5 in the closed position of the door arrangement 1, the coupling element 20 with the second coupling end face profile 29 is arranged spaced apart from the parking end face profile 30 of the parking element 22. This means that the trapezoidal projections 42 of the second coupling end face profile 29 are arranged spaced apart, i.e. spaced apart along the center longitudinal axis 7, from the trapezoidal recesses 41 of the parking element 22. The respective base 44 of a trapezoidal projection 42 does not rest on a base 44 corresponding thereto of a trapezoidal recess 41. Quite the contrary, the coupling element 20 and the parking element 22 are supported against one another on the respective outer bases 44 of the trapezoidal projections 42 axially along the center longitudinal axis 7. There is therefore no positive connection between the coupling element 20 and the parking element 22. In the closed position shown in FIG. 5, the torsion spring 33 can be rotated with respect to the center longitudinal axis 7 compared to an arrangement relieved of tension and therefore be pretensioned. Owing to this pretensioning according to the arrangement shown in FIG. 5, it is ensured that the door leaf 2 is pressed against the door frame 3. It is basically also possible for the door arrangement 1 to not be pretensioned in the closed position. This means that the torsion spring 33 does not transmit any closing torque to the closing drive element 32. In an arrangement of this type, the closing hinge 5 is torque-free.

If the door arrangement 1 is transferred from the closed position into the opened position, i.e. the door leaf 2 is pivoted in relation to the door frame 3, the closing hinge housing upper part 9 is rotated or pivoted by means of the associated fastening journal 11 about the center longitudinal axis 7 arranged concentrically with respect to the pivot axis 4. The rotation of the closing hinge housing upper part 9 is transmitted by means of the profile recess 15 to the rotating receiver element 14 of the rotating receiver unit 12. The rotating receiver element 14 transmits the rotating movement via the profile recess 15 to the rotating drive element 18, which is non-rotatably connected to the rotating receiver element 14 with respect to the center longitudinal axis 7. The pivoting movement of the rotating receiver element 14, according to the view in FIG. 6, takes place along a direction arrow 45, i.e. from right to left.

The pivoting movement of the door leaf 2 brings about a rotation of the rotating receiver element 14 along the opening direction 45. The rotating movement along the opening direction 45 of the rotating drive element 18 is transmitted by means of the rotating receiver end face profile 27 to the first coupling end face profile 28, in that, in each case, the rear flank 43, viewed in the direction 45 of rotation, of a projection 42 rests on the flank 43 corresponding thereto of a trapezoidal recess 41 of the coupling end face profile 28.

The coupling element 20 transmits the rotating movement to the closing drive element 32 by means of the profile guide 40, by means of which the coupling element 20 is non-rotatably connected to the closing drive element 32 with respect to the center longitudinal axis 7. By means of the rotation of the closing drive element 32 about the center longitudinal axis 7, the first, upper end 34 of the torsion spring 33, which is arranged eccentrically with respect to the center longitudinal axis 7, is likewise also rotated. Since the torsion spring 33 is blocked by the second end 35 by means of the base plate 31 and the control disc 37 with respect to a rotation about the center longitudinal axis 7, the rotation of the first end 34 leads to a torsional stress loading of the torsion spring 33. If the rotating movement is continued along the direction 45 of rotation, the torsion spring 33 is further tensioned.

Figure 6:
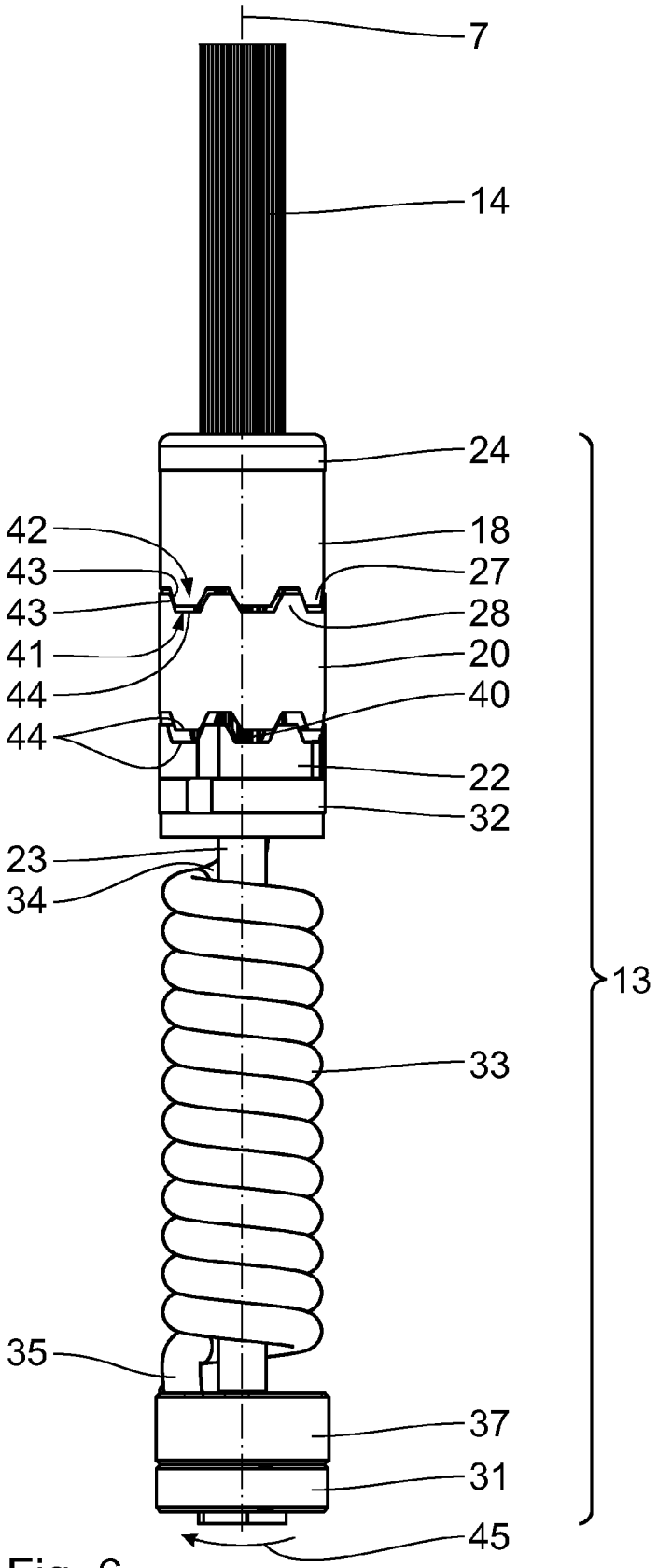
FIG. 6 is a view, corresponding to FIG. 5, of the closing hinge in a different closing arrangement.

At the same time, as soon as the coupling element 20 has been rotated about the center longitudinal axis 7 in such a way that the second coupling end face profile 29 can engage with the parking end face profile 30, as shown in FIG. 6, a displacement of the coupling element 20 takes place axially along the center longitudinal axis 7 away from the rotating drive element 18 and toward the parking element 22. The parking element 22 is blocked with respect to a rotation about the center longitudinal axis 7. It is mounted secured to the housing. The axial displacement of the coupling element 20 is produced from a force component acting parallel to the center longitudinal axis 7, which is caused as a result of the loading of the coupling element 20 by the rotating drive element 18 and is inserted via the flanks 43. Since the coupling element 20 is connected by the profile guide 40 to the closing drive element 32, a guided, axial displacement along the center longitudinal axis 7 is possible.

Figure 7:
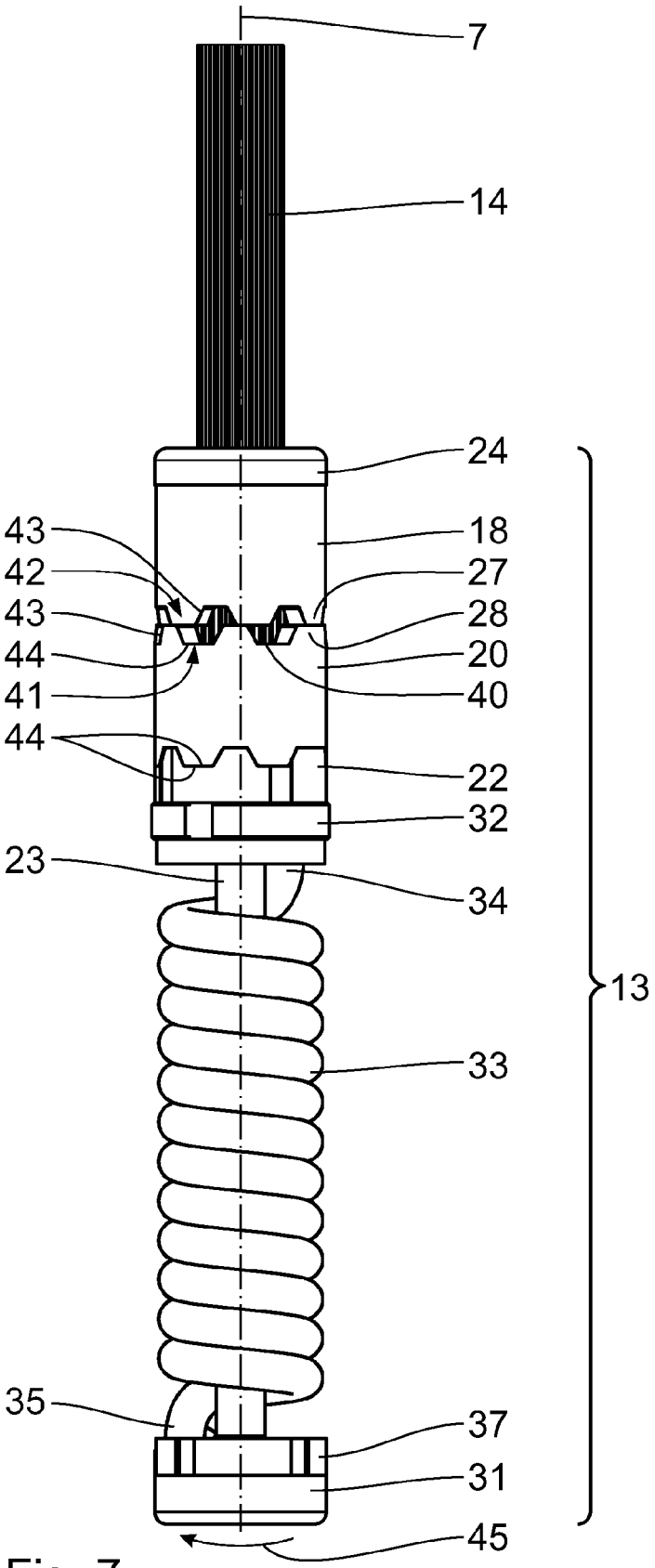
FIG. 7 is a view, corresponding to FIG. 5, of the closing hinge in a freely rotating arrangement.

In an arrangement shown in FIG. 7, the torsion spring 33 is maximally tensioned. This is because the coupling element 20 is maximally rotated relative to the closed position of the door arrangement 1 according to FIG. 5 with respect to the center longitudinal axis 7. In this arrangement, the coupling element 20 is rotated in relation to the parking element 22 about a closing angle b.

As soon as the closing angle b has been reached, the coupling element 20 rests with the second coupling end face profile 29 on the parking end face profile 30 of the parking element 22, as shown in FIG. 7. Since the parking element 22 is mounted on the closing hinge 5 so as to be secured to the housing, a further rotation of the coupling element 20 and the closing drive element 32 non-rotatably connected thereto with respect to the center longitudinal axis 7 is not possible. This means that a further tensioning of the torsion spring 33 no longer takes place as soon as the coupling element 20 rests completely with the second coupling end face profile 29 on the parking end face profile 30.

If a further pivoting movement of the door leaf 2 takes place in relation to the door frame 3, the rotating drive element 18 is further rotated in relation to the coupling element 20. Since the end face profiles 27, 28 are arranged axially spaced apart from one another, a rotating movement of the rotating drive element 18 is possible independently of the coupling element 20. With respect to a rotating movement about the center longitudinal axis 7, the rotating drive element 18 and the coupling element 20 in the arrangement shown in FIG. 7, which is also called the freely rotating arrangement, are decoupled from one another. Accordingly, the coupling element 20 in the freely rotating arrangement shown is connected to the parking element 22 in a torque-transmitting manner or non-rotatably connected to the parking element 22, as the latter is mounted secured to the housing Accordingly, the parking element 22 is suitable to receive a closing torque coming from the torsion spring 33 transmitted to the closing drive element 32 and further to the coupling element 20, in that the coupling element 20 is non-rotatably held on the parking element 22.

The closing torque exerted by the torsion spring 33 and acting about the center longitudinal axis 7 can be adjusted, for example, in that the torsion spring 33 used is exchangeable. It is, for example, possible, to use torsion springs of different materials, which have different spring constants. It is also possible to change the spring characteristic in that stronger or weaker torsion springs are used, i.e. torsion springs with a larger or smaller spring wire diameter.

The closing angle b, which determines a transition from the closing arrangement as, for example, in FIG. 6, in which the closing torque is exerted by the freely rotating closing unit 13 on the rotating receiver unit 12 in a closing direction of rotation, into the freely rotating arrangement, can be adjusted, for example, by the design of the end face profiles 27, 28 and/or 29, 30.

According to the view in FIG. 7, the rotating drive element 18 is axially supported in the freely rotating arrangement with a respective outer base 44 of a trapezoidal projection 42 on a corresponding outer base 44 of a trapezoidal projection 42 of the first coupling end face profile 28 of the coupling element 20. The rotating drive element 18 and the coupling element 20 are disengaged. In this arrangement, a rotating movement of the rotating drive element 18 about the center longitudinal axis 7 decoupled from the coupling element 20 is possible. In particular, upon the rotation of the rotating drive element 18 and therefore of the rotating receiver element 14 and finally of the door leaf 2 in the freely rotating arrangement according to FIG. 7, no closing torque acts.

It is also possible to use a so-called intelligent torsion spring, which can be activated in a specific rotation angle range with respect to the center longitudinal axis 7, so a closing torque to be exerted by the closing hinge 5 can be adjusted individually depending on the requirement of the door arrangement 1.

The coupling element 20 is thus used to connect the rotating drive element 18 to the tensioning unit 19 in a torque-transmitting manner in the closed position of the door arrangement 1 according to FIG. 5 and of the closing arrangement according to FIG. 6. Alternatively, the coupling element 20 is used to decouple a torque-transmitting connection of the rotating drive element 18 to the tensioning unit 19, so the rotating drive element 18 is freely rotatable in relation to the tensioning unit 19 with respect to the center longitudinal axis 7, and, in particular, no torque counteracts the rotating movement upon a rotation of the rotating drive element 18.

When the door arrangement 1 is closed, the door leaf 2 is pivoted about the pivot axis 4 toward the door frame 3. Accordingly, the rotating receiver element 14 and therefore the non-rotatably connected rotating drive element 18 are rotated about the center longitudinal axis 7 counter to the opening direction 45. A soon as the current pivoting angle a reaches the closing angle b, a transition of the closing hinge 5 takes place from the freely rotating arrangement into the closing arrangement, in that the rotating drive element 18 is arranged with respect to the coupling element 20 in such a way that the first coupling end face profile 28 can engage in the rotating receiver end face profile 27. According, an axial displacement of the coupling element 20 from the parking element 22 toward the rotating drive element 18 is made possible. The axial displacement of the coupling element 20 to the rotating drive element 18 takes place because of the torsional stress of the torsion spring 33, which, as soon as an axial displacement of the coupling element 20 along the center longitudinal axis 7 is no longer blocked, exerts a closing torque on the coupling element 20 and therefore on the rotating drive element 18.

As soon as the closing arrangement has been reached, i.e. the pivoting angle a reaches the closing angle b or falls below it, a closing of the door leaf 2 of the door arrangement 1 takes place automatically until the door leaf 2 rests in a closing manner on the door frame 3 or the coupling element 20 rests on the rotating drive element 18 according to FIG. 5.

The damping hinge 6 will be described in more detail below in accordance with a first embodiment with the aid of FIGS. 8 to 11. The damping hinge 6 has a hollow cylindrical damping hinge housing 47 with respect to a rotational axis 46, with a damping hinge housing lower part 48 and a damping hinge housing upper part 49. The damping hinge 6 is also called a band with the damping function. The band with the damping function has the two housing parts 48, 49 and is configured as a two-part band. The damping hinge 6 is arranged with the rotational axis 46 concentrically with respect to the pivot axis 4 of the door arrangement 1. In accordance with the closing hinge 5, the damping hinge 6 also has a cylindrical housing 47 with an external diameter of 16 mm and a length along the rotational axis 46 of 130 mm. A housing 47 of this type substantially corresponds to the housing size of a hinge used as standard to connect a door leaf to a door frame. The use of the closing hinge 5 and the damping hinge 6 in the door arrangement 1 is therefore inconspicuous and does not differ with respect to the visual appearance from previously known door arrangements. The hinges 5, 6 can be retrofitted in an existing door arrangement. It is also possible to only retrofit one of the two hinges 5 or 6. Because of the substantially identical configuration with respect to the outer form in comparison to standard door hinges, no or only slight adaptations are required for said retrofitting. However, the door arrangement 1, because of the integration of the damping function of the damping hinge 6 and the closing function of the closing hinge 5, has an improved functionality.

Likewise, in accordance with the closing hinge 5, the damping hinge 6 on the housing parts 48, 49 in each case has fastening journals 11, which are used to fasten the damping hinge housing 47 on the door leaf 2 and the door frame 3.

The damping hinge housing upper part 49 is tubular, in other words hollow and closed on an upper side remote from the damping hinge housing lower part 48 by a cover 50. A cylindrical recess 51 is provided in an upper portion of the damping hinge housing upper part 49 facing the cover 50.

Along the rotational axis 46, a profile portion 52 adjoins the recess 51. The profile portion 52 has a reduced internal diameter compared to the recess 51. In the profile portion 52, a cross-sectional face oriented perpendicularly with respect to the rotational axis 46 is non-round and has a plurality of triangular projections extending radially outwardly with respect to the rotational axis 46. The profile portion 52 is a multi-tooth profile. The multi-tooth profile is oriented parallel to the rotational axis 46.

A cylindrical receptacle 53 adjoins the profile portion 52 in a lower end facing the damping hinge housing lower part 48. A threaded sleeve 54 is inserted in the cylindrical receptacle 53. The threaded sleeve 54 has a collar portion 55 with a maximum external diameter with respect to the rotational axis 46. The external diameter of the collar portion 55 corresponds to the external diameters of the damping hinge housing parts 48, 49. Proceeding from the collar portion 55, along the rotational axis 46 there extends an upper portion 56, with which the threaded sleeve 54 is inserted in the receptacle 53. The external diameter of the upper portion 56 is correspondingly adapted to the internal diameter of the receptacle 53. A lower portion 57 of the threaded sleeve 54 extends on a side of the collar portion 55 remote from the upper portion 56. On the lower portion 57, the threaded sleeve 54 has an external thread, with which the threaded sleeve 54 is screwed into the damping hinge housing lower part 48. The threaded sleeve 54 is preferably produced from plastics material or brass.

An annular stop element 58 is provided on a lower side of the lower portion 57. The stop element 58 is preferably produced from plastics material and may, for example, be produced in one piece with the threaded sleeve 54. The stop element 58 rests peripherally in a fluid-sealing manner on an inner wall of the damping hinge housing lower part 48. The threaded sleeve 54 is sealed by the stop element 58 in the damping hinge housing lower part 48.

On an inner side, the threaded sleeve 54 has a steep thread, which has a thread pitch such that a rotation of a connecting piece provided with an external thread corresponding to the steep thread takes place for an axial displacement along the rotational axis 46. The steep thread is not self-locking and is configured as a movement thread.

A base cap 59 is screwed into the housing lower part 48 on a lower side of the damping hinge housing lower part 48 remote from the threaded sleeve 54. For this purpose, the base cap 59 has a torque transmission means in the form of a hexagon socket recess 60. The base cap 59 is sealed relative to the housing lower part 48 with an O-ring seal 61.

The damping hinge housing upper part 49 is connected by the threaded sleeve 54 to the damping hinge housing lower part 48. The two housing parts 48, 49 are arranged coaxially with respect to the rotational axis 46 and can be rotated in relation to one another about the rotational axis 46.

A kinematics unit 62 is arranged in the damping hinge 6, i.e. in the damping hinge housing 47. The kinematics unit 62 comprises an axial element 63, which has a non-round cross-section, oriented perpendicular to the rotational axis 46, in the form of a multi-tooth profile. The external profile of the axial element 63 corresponds with the profile portion 52 of the damping hinge housing upper part 49. The axial element 63 can be displaced along the rotational axis 46 in the profile portion 52. At a lower end remote from the cover 50, it has an internal thread, into which a rotating element 64 of the kinematics unit 62 is screwed. The rotating element 64 is non-rotatably connected to the axial element 63 with respect to a rotation about the rotational axis 46. At an outer lateral surface, it has a steep thread 65, which corresponds with a corresponding internal thread of the threaded sleeve 54. Since the threaded sleeve 54 is screwed into the damping hinge housing lower part 48, the sleeve 54 is non-rotatably connected to the housing lower part 48. The axial element 63 and the rotating element 64 may, in particular, be produced from one part.

The rotating element 64 is connected to a piston rod 66 at a lower end remote from the axial element 63. The piston rod 66 is fastened to the rotating element 64 by means of a threaded rod 67, which is guided through a corresponding central bore of the axial element 63 and of the rotating element 64. The threaded rod 67 is guided out of the axial element 63 at an upper end and held by a fastening nut 68. A damping piston 69 is provided on the piston rod 66 at a lower end of the piston rod 66 remote from the rotating element 64. The damping piston 69 is fixed on the piston rod 66. It can be displaced in a fluid-tight manner in the housing lower part 48 and has a ring seal 70.

Accordingly, the damping hinge 6 has a damping unit 71, which comprises the damping piston 69 and a damping cylinder 72. The damping piston 69 can be displaced along the rotational axis 46 within the damping cylinder 72. The damping cylinder 72 is limited by the sealed stop element 58 on an upper side, by the sealed base cap 59 on a lower side and peripherally by the damping hinge housing lower part 48. It is also possible to provide a separate damping cylinder 72 not integrated in the housing lower part 48. The damping cylinder 72 integrated in the housing lower part 48 according to the embodiment shown leads to a simplified mode of construction of the damping hinge 6 and therefore to a cost reduction. The damping unit 71 correspondingly has a linear damper to damp a linear movement along the rotational axis 46. For this purpose, provided in the damping piston 69 is a through-flow opening, through which a damping fluid such as, for example oil, can flow upon a displacement of the damping piston 69. Arranged in an interior space surrounded by the damping cylinder 72 is a hydraulic medium such as, for example oil. The filling level of this oil column is characterized in FIG. 9 by the hatched face above the base cap 59. As soon as the damping piston 69 is immersed in the oil column, the oil forcibly flows through the through-flow opening. The displacement of the piston 69 is thereby damped. The axial spacing of the oil column from the damping piston 69 and therefore the beginning of the damping effect, can be achieved by the base cap 59, which is screwed into the damping hinge housing lower part 48. Accordingly, the damping angle c can be adjusted by axial displacement of the base cap 59.

Figure 8:
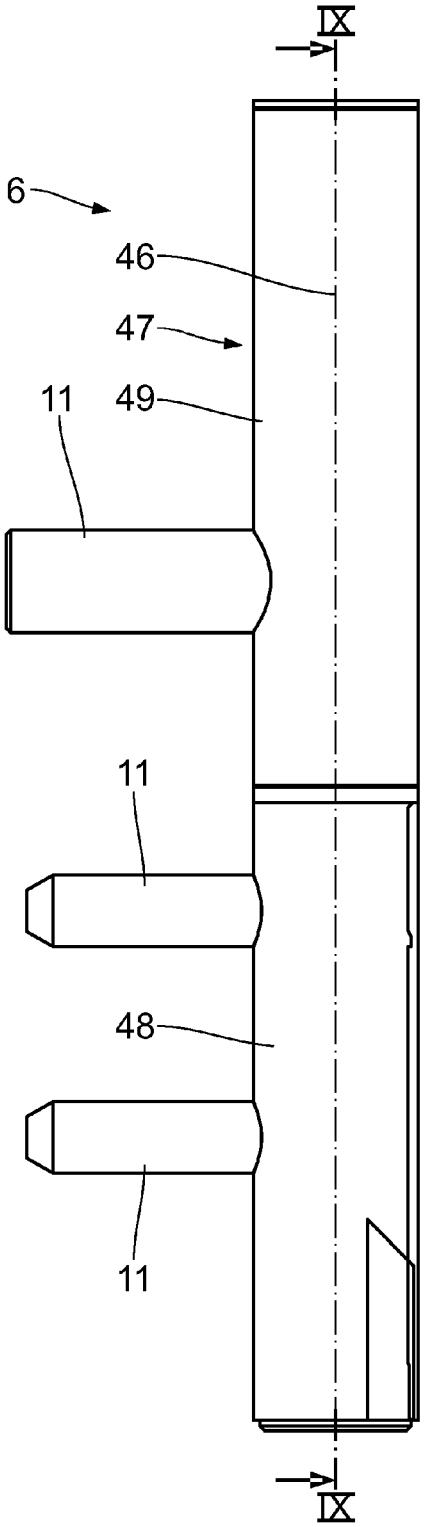
FIG. 8 is a side view of a damping hinge according to a first embodiment in an opened position of the door arrangement shown in FIG. 1.
Figure 9:
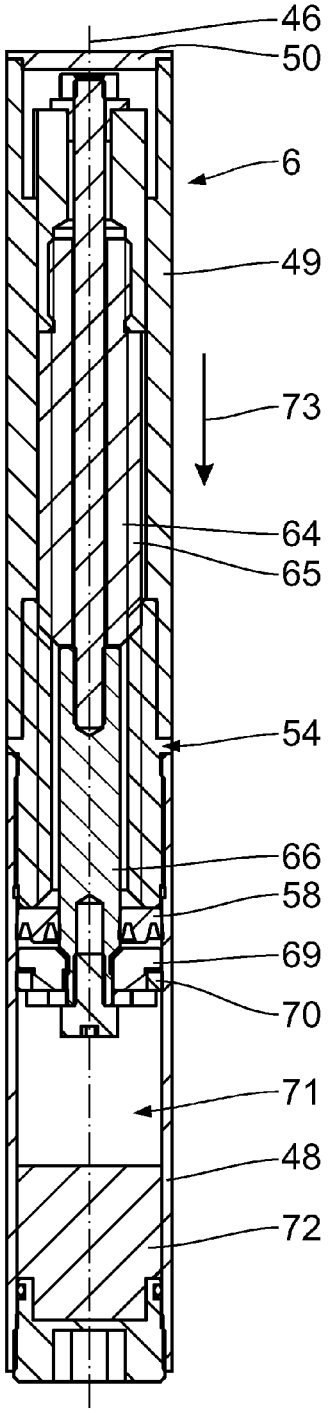
FIG. 9 is a longitudinal sectional view along the section line IX-IX in FIG. 8.
Figure 10:
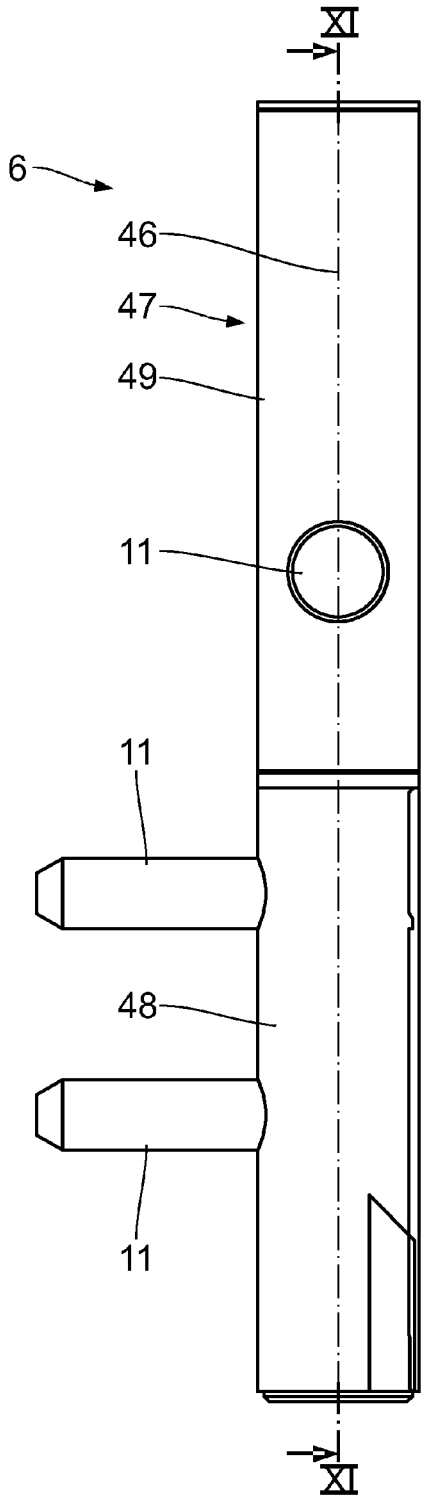
FIG. 10 is a side view, corresponding to FIG. 8, of the damping hinge in a closed position.
Figure 11:
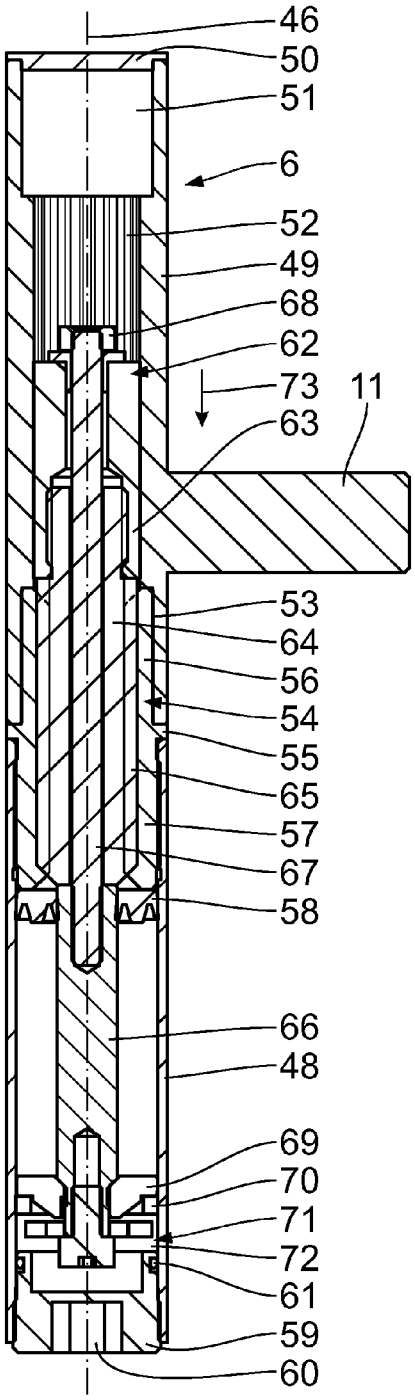
FIG. 11 is a longitudinal sectional view along the section line XI-XI in FIG. 10.

The mode of functioning of the damping hinge 6 will be described below with the aid of FIGS. 8 to 11, starting from the arrangement of the damping hinge 6 according to FIGS. 8 and 9 in the opened position of the door arrangement 1.

If the door leaf 2 is pivoted in relation to the door frame 3 about the pivot axis 4, this pivoting movement is transmitted by means of the associated fastening journal 11 to the damping hinge housing upper part 49. Since the axial element 63 is non-rotatably received in the profile portion 52 of the housing upper part 49 with respect to a rotation about the rotational axis 46, the axial element 63 is also rotated about the rotational axis 46. Equally, the rotating element 64 screwed into the axial element 63 is rotated about the rotational axis 46. Since the rotating element 64 has the external steep thread 65 and is arranged therewith in the threaded sleeve 54, the rotating movement of the housing upper part 49 is converted into an axial movement along the rotational axis 46. This means that the kinematics unit 62 with the axial element 63 and the rotating element 64 connected thereto is displaced along the rotational axis 46 according to FIGS. 10 and 11 downwardly along a damping direction 73. With the displacement downwardly, in addition to the kinematics unit 62, the damping piston 69 connected thereto is also displaced. Accordingly, the volume of a lower part working compartment of the damping cylinder 72 is reduced by the damping piston 69 and the damping fluid present therein is pressed through the through-flow opening into an upper part working compartment, which is arranged above the piston 69, of the damping cylinder 72. The axial displacement of the damping piston 69 of the damping unit 71 takes place in a damped manner. In particular, the damping effect depends on the displacement speed of the piston 69. The faster the displacement of the piston 69, the higher are the damping forces of the damping fluid because of the dynamic fluid properties thereof. The closing moving of the door leaf 2 is decelerated correspondingly sharply. This also means that lower damping forces act at low closing speeds.

It is possible to establish a damping angle c in such a way that the damping effect of the damping hinge 6 only starts when a pivoting angle a about the pivot axis 4 is smaller than the adjusted damping angle c. As a result, the damping effect of the damping hinge 6 can be adjusted to a required pivoting angle range. In particular, it is not necessary for a damping of a pivoting movement to take place in a non-critical range, i.e. at large pivoting angles a. The adjustment of the damping angle c may, for example, take place in that, in a pivoting angle range, the torque transmission takes place from the housing upper part 49 to the axial element 63 in a specific pivoting angle range.

Accordingly, it is also possible to adapt an axial extent of the steep thread 65 along the rotational axis 46 so that an axial displacement along the damping direction 73 and therefore a damping effect only take place in a specific pivoting angle range. It is also possible, in addition or alternatively, to influence the damping effect in that various hydraulic media having different damping behavior are used. It is also conceivable to additionally provide a mechanical spring, for example a helical spring, in the damping cylinder 72.

Figure 12:
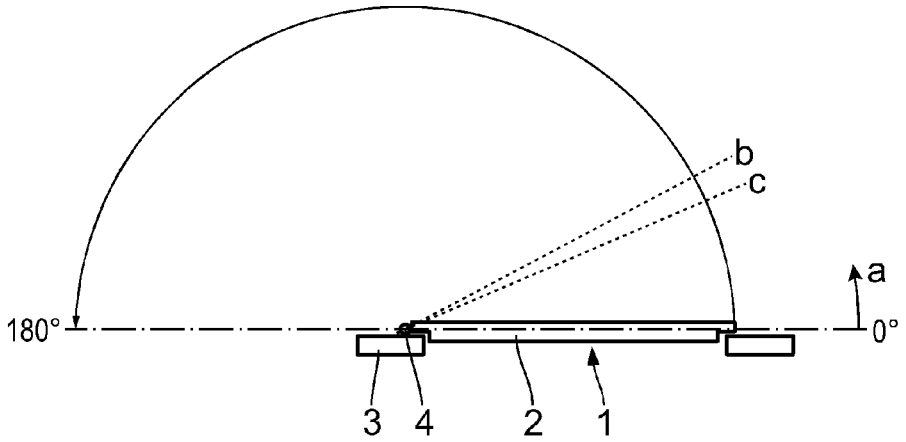
FIG. 12 is the schematic plan view of the door arrangement according to FIG. 1 with a view of a pivoting angle range.
Figure 13:
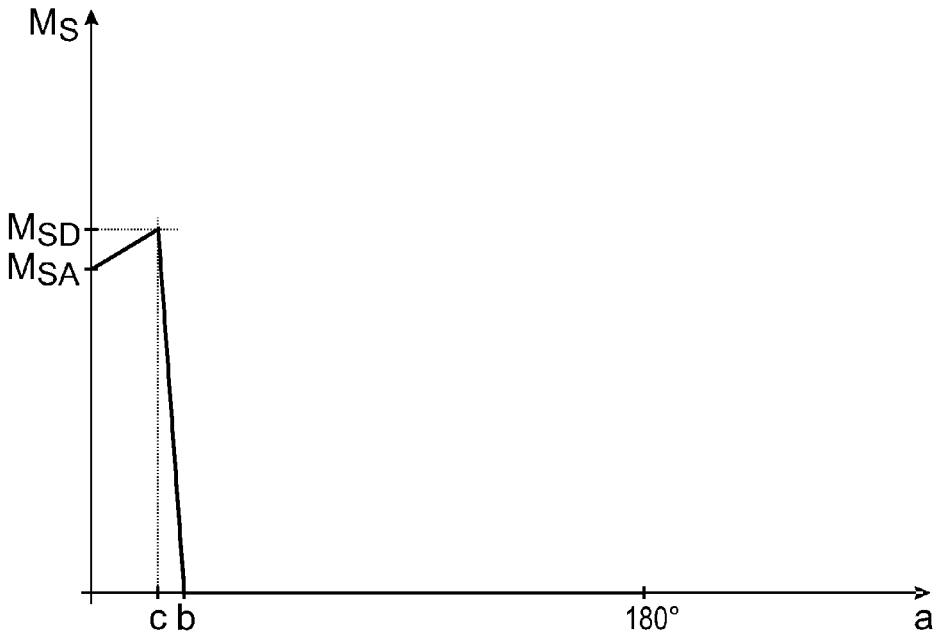
FIG. 13 is a schematic view of a functional dependency of a closing torque depending on a pivoting angle.

The mode of functioning of the door arrangement 1 with the closing hinge 5 and the damping hinge 6 will be described below with the aid of FIGS. 12 and 13. FIG. 12 schematically shows a plan view of the door arrangement 1 with the door leaf 2, which rests in a closing manner on the door frame 3 and is pivotably mounted about the pivot axis 4 on the door frame 3. According to the view in FIG. 12, the door arrangement 1 is shown in a closed position, i.e. the door leaf 2 rests on the door frame 3 in a closing manner.

Proceeding from this closed position, the door arrangement 1 can be transferred into an opened position. According to the embodiment shown, a maximum pivoting angle a of at least 180° is possible here. It is advantageous if the maximum pivoting angle a is at least 110° and, in particular at least 135°. Furthermore, entered in FIG. 12 are the closing angle b, which is arranged at a pivoting angle position of about 27°, and the damping angle c, which is arranged at a pivoting angle position of about 22°.

It can also be advantageous to select the damping angle c to be larger than the closing angle b. In this case, when the door arrangement 1 is being closed, the damping function starts before the closing function, which is also called the pulling to function. Accordingly, a larger angle range is available to damp a slamming door leaf. The damping torque is comparatively small.

If the door leaf 2 is in a pivoting angle range of greater than 27°, in other words greater than the closing angle b, the closing hinge 5 is in the freely rotating arrangement, i.e. the door leaf 2 can be pivoted in relation to the door frame 3 without torque loading by a closing torque.

When the door leaf 2 is pivoted toward the door frame 3 and the pivoting angle b has been reached, the closing function of the closing hinge 5 is activated and the door leaf 2 is automatically drawn toward the door frame 3.

As soon as the pivoting angle, which continuously reduces in the closing arrangement of the closing hinge 5, reaches the damping angle c, the damping function of the damping hinge 6 is activated, so the closing movement brought about by the closing hinge 5 is damped by the damping hinge 6. The closing movement of the door arrangement 1 takes place automatically and in a damped manner. An inadvertent slamming of the door is prevented. Furthermore, it is guaranteed that the door arrangement 1 can be pivoted without torque, in particular at larger pivoting angles. An actuation of this type is possible in a smooth manner.

In order to actuate the door arrangement 1 from the closed position, i.e. to open the door leaf 2, an initial closing torque $M_{SA}$ firstly has to be overcome, said initial closing torque increasing until the damping angle c is reached to a maximum, the so-called closing damping torque $M_{SD}$. The damping piston 69 can also be configured in such a way that the damping function only acts in a one-sided manner, in particular when closing the door leaf 2. This means that when opening the door leaf 2, no additional damping torque caused by the damping hinge 6 has to be overcome. Accordingly, the initial closing torque $M_{SA}$ and the closing damping torque $M_{SD}$ are identical and caused substantially by the pretensioning of the torsion spring 33.

As soon as the damping function of the damping hinge 6 is deactivated, in other words at a pivoting angle a, which is greater than the damping angle c, the closing torque is reduced and disappears from a pivoting angle a, which is greater than the closing angle b. According to FIG. 13, the closing angle b can be selected to be greater than the damping angle c. The degree numbers given for the closing angle b and the damping angle c are by way of example. Depending on the application, other degree numbers can also be selected. In particular, the spacing of the closing angle b from the damping angle c can also be varied. If the damping piston 69 acts on both sides, it may be advantageous to select the damping angle c to be as small as possible in order to reduce a force requirement when opening the door arrangement 1. At the same time, the damping angle c should be large enough in this case in order to ensure adequate damping of the door arrangement 1 to be closed. Ideally, the damping angle c is between 15° and 30° of the pivoting angle a, in particular between 20° and 25°. Accordingly, the closing angle b should be selected to be large enough to ensure automatic closing of the door arrangement 1 as soon as the door leaf 2 is moved in the direction of the door frame 3 and falls below a minimum opening angle defined by the closing angle b. At the same time, the closing angle b should, however, be selected to be small enough to prevent the door arrangement 1 automatically closing in an arrangement with a pivoting angle a of any size, in order, for example, to ensure that the door arrangement 1 is left open in a targeted manner. It is particularly advantageous to select the closing angle b to be from 20° to 30° and, in particular from 25° to 30°.

Figure 14:
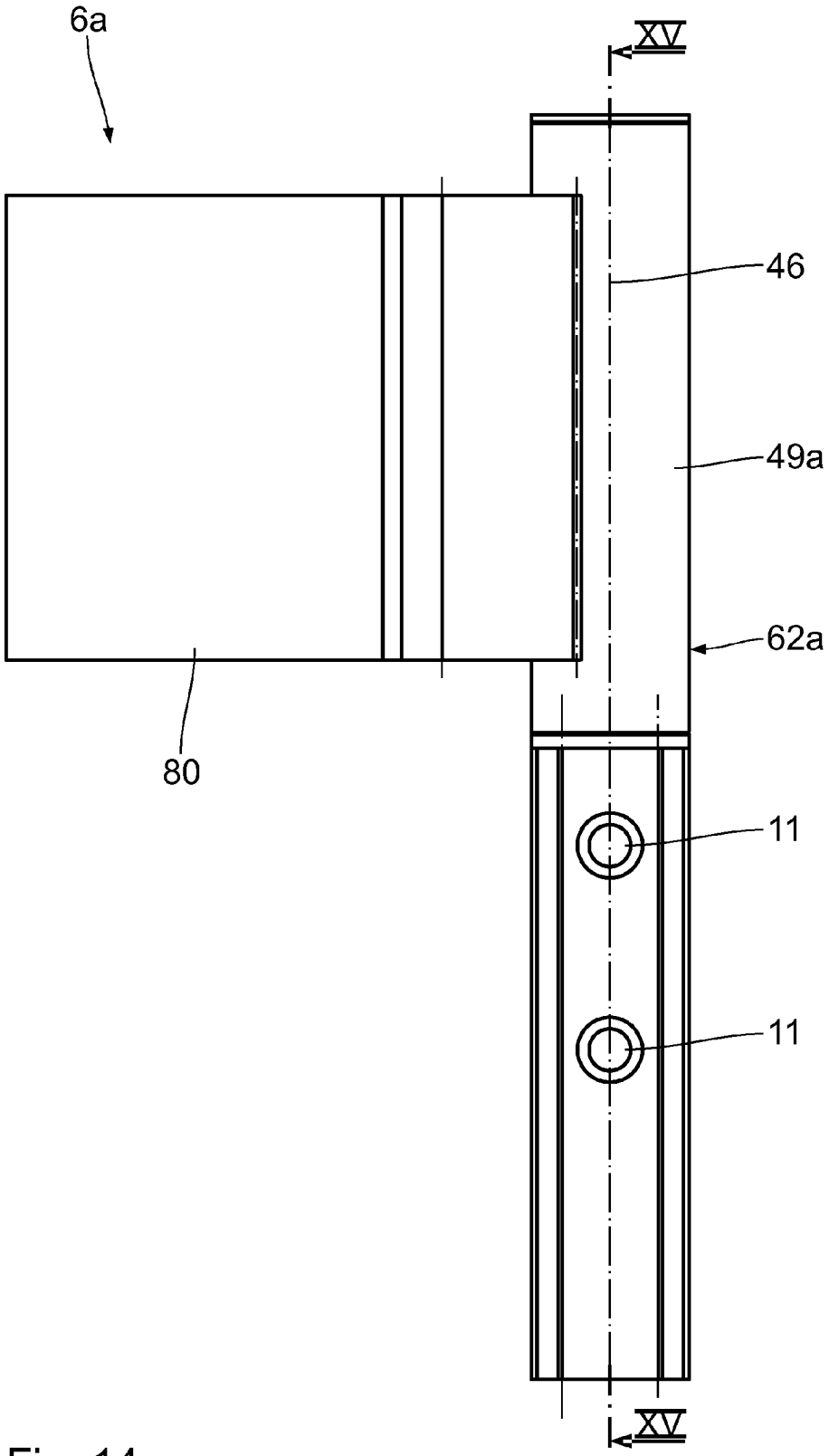
FIG. 14 is a side view, corresponding to FIG. 8, of a damping hinge according to a second embodiment.
Figure 15:
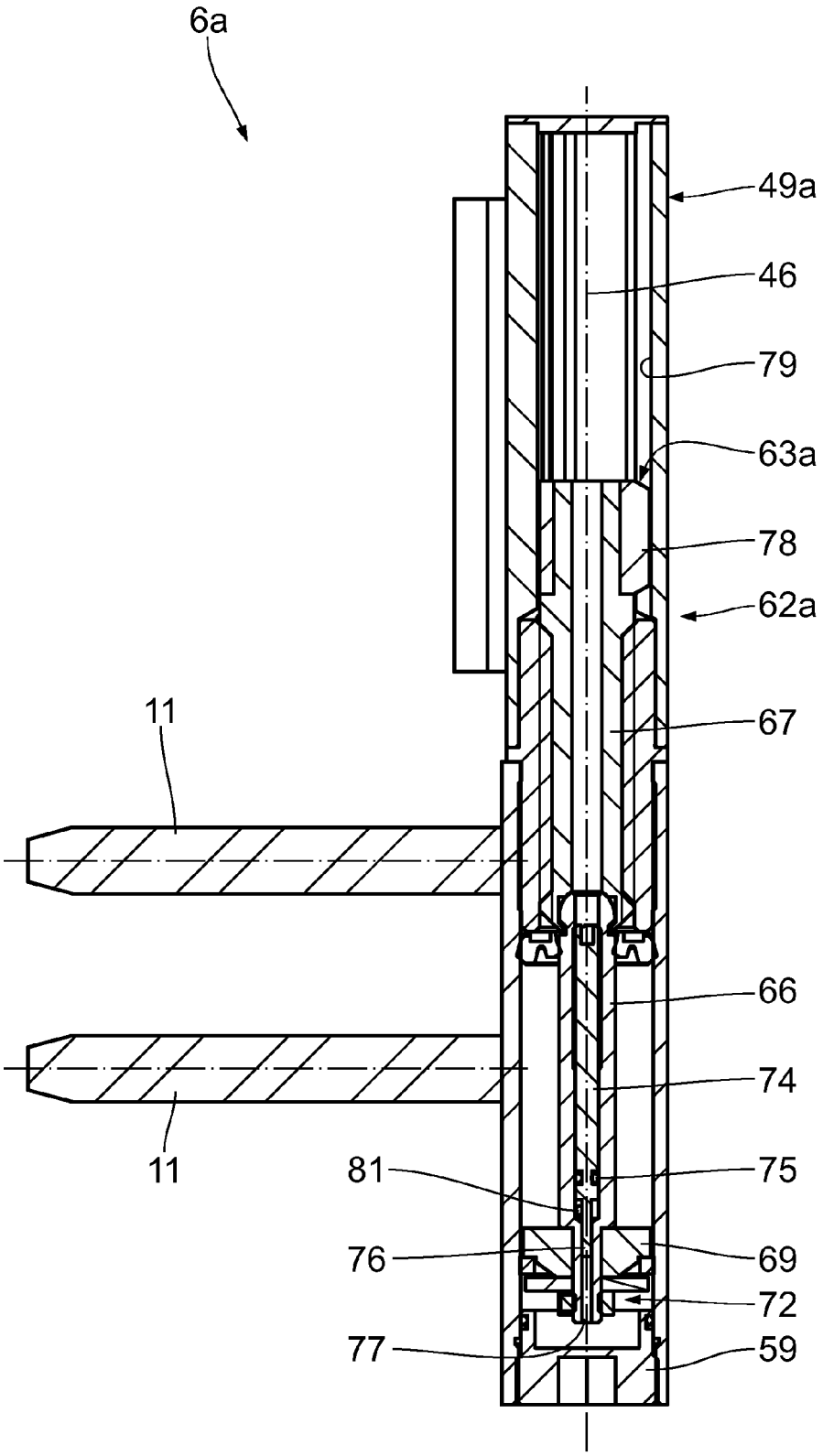
FIG. 15 is a longitudinal sectional view along the section line XV-XV in FIG. 14.

With reference to FIGS. 14 and 15, a second embodiment of a damping hinge will be described below. Structurally identical parts receive the same reference numerals as in the first embodiment, to the description of which reference is hereby made. Structurally different, but functionally similar parts receive the same reference numerals with an "a" placed thereafter.

The essential difference is that the damping hinge 6*a* has a throttle rod 74. The throttle rod 74 is arranged within the piston rod 66. The throttle rod 74 and the piston rod 66 are arranged concentrically with respect to the rotational axis 46. The throttle rod 74 can be displaced along the rotational axis 46 within the piston rod 66. The throttle rod 74 is sealed by means of an O-ring 75 in the piston rod 66.

The throttle rod 74 has a pin-like continuation 76, which is arranged in a channel 77 of the piston rod 66 provided for this, at an end facing the damping piston 69. According to the embodiment shown, the continuation 76 is cylindrical, i.e. an annular gap is formed between the continuation 76 and the channel 77 and forms a throttle section for the damping fluid. The longer the throttle section, i.e. the deeper the continuation 76 is arranged in the channel 77, the larger is the damping effect of the damping hinge. It is also possible for the continuation 76 along the rotational axis 46 to be directed conically tapering toward the damping piston 69.

On an outer side, the throttle rod 74 has an external movement thread, which corresponds with an internal thread of the piston rod 66. By means of a tool, not shown, the throttle rod 74 can be rotated, for example, on a non-round internal cross-section, in particular a hexagon socket, with respect to the rotation axis 46. As a result of the movement thread, the throttle rod 74 is axially displaced relative to the piston rod 66. As a result, the immersion depth of the continuation 76 in the channel 77 can be adjusted. The damping effect of the damping hinge 6*a* can be adjusted by means of the throttle rod 74.

The kinematics unit 62*a* comprises an axial element 63*a*, which has a non-round cross-section oriented perpendicular to the rotational axis 46. In contrast to the damping hinge 6 according to the first embodiment, this is not a multi-tooth profile, but a rotating entrainer. The rotating entrainer is substantially cylindrical and, along an outer cylindrical lateral surface, has three entrainer webs 78 extending radially outwardly with respect to the rotational axis 46. The entrainer webs 78 are arranged at a uniform peripheral angle spacing of 120° with respect to the rotational axis 46. Each entrainer web 78 engages in a groove 79 provided for this, which is integrated in the damping hinge housing upper part 49*a*.

It is possible to implement the kinematics unit 62*a* with a rotating play, in that, for example, the groove 79 has a greater width than the entrainer web 78. It is thereby possible that, in a specific rotation angle range of the door, the axial element 63*a* is not rotated upon an actuation of the door. As a result, the threaded rod 67 can only be rotated from an, in particular fixable, closing angle of the door and the damping piston 69 moved downwardly in the direction of the base cap 59. As a result it is possible for the damping hinge 6*a* to be built shorter overall, because a reduced thread length of the threaded rod 67 is necessary for a shorter damping stroke movement. The rotating play of the kinematics unit 62*a* is thus a freely running function, which will be described in more detail with the aid of a further embodiment (FIGS. 19 to 23).

The mode of functioning of the damping hinge 6*a* will be described below with the aid of FIGS. 14 and 15.

If the door leaf 2 is pivoted in relation to the door frame 3 about the pivot axis 4, this pivoting movement is transmitted by means of a housing fastening 80 to the damping hinge housing upper part 49*a*. Since the axial element 63*a* is received in the housing upper part 49*a* with respect to a rotation about the rotational axis 46 with the entrainer webs 78 in the grooves 79, the axial element 63*a* is also rotated about the rotational axis 46. The axial element 63*a* is non-rotatably connected with respect to the rotational axis 46 to the threaded rod 67, so the latter is also rotated about the rotational axis 46. With the displacement of the piston rod 66 and the damping piston 69 fastened thereon downwardly, a volume of a lower part working compartment of the damping cylinder 72 is reduced by the damping piston 69 and a damping fluid present therein is pressed through the channel 77 past the continuation 76 through a transverse bore 81 arranged in the piston rod 66 into an upper part working compartment of the damping cylinder 72 arranged above the piston 69. In particular because of the arrangement of the continuation 76 in the channel 77, the axial displacement of the damping piston 69 takes place in a damped manner. If the continuation 76, as described above, tapers conically, the damping effect can be increased with increasing closing of the door. This means that the damping effect is greater, the greater the proportion of the continuation 76 arranged within the channel 77.

Figure 16:
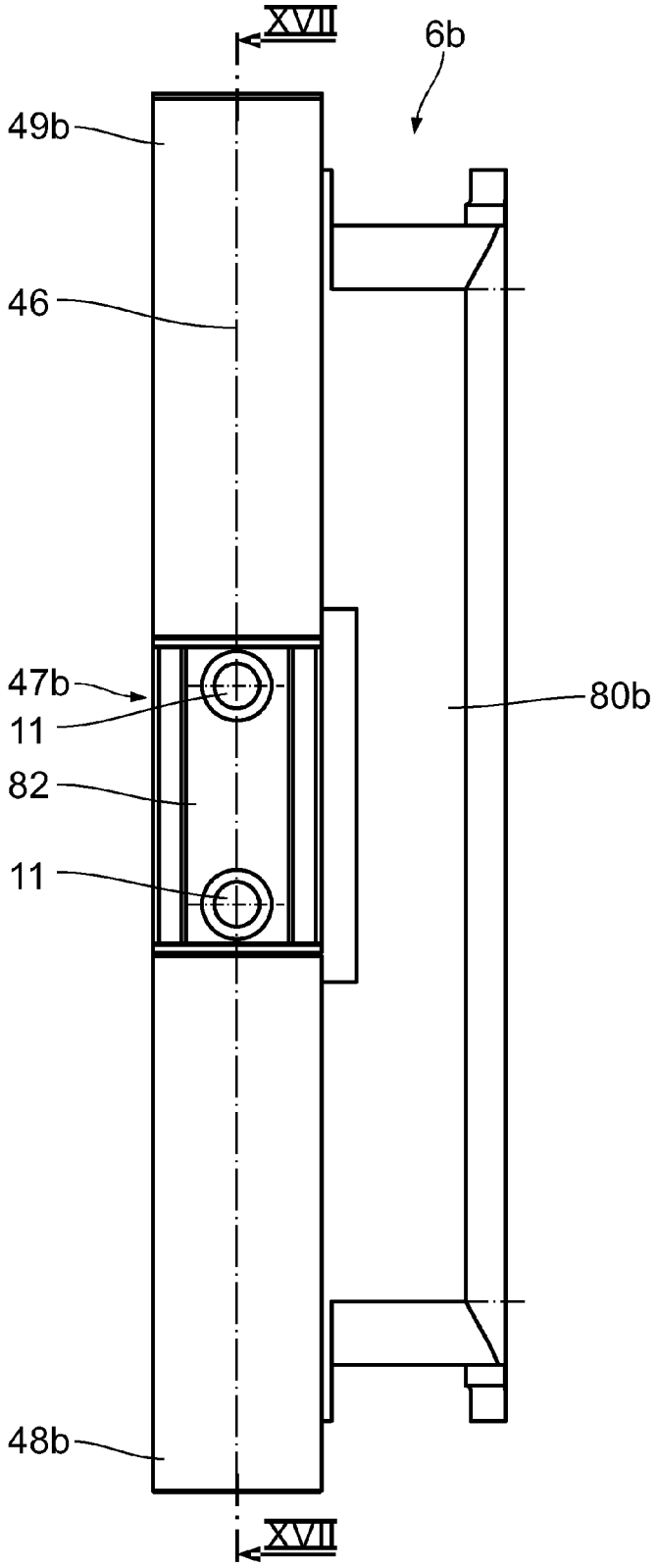
FIG. 16 is a side view of a damping hinge according to a third embodiment.
Figure 17:
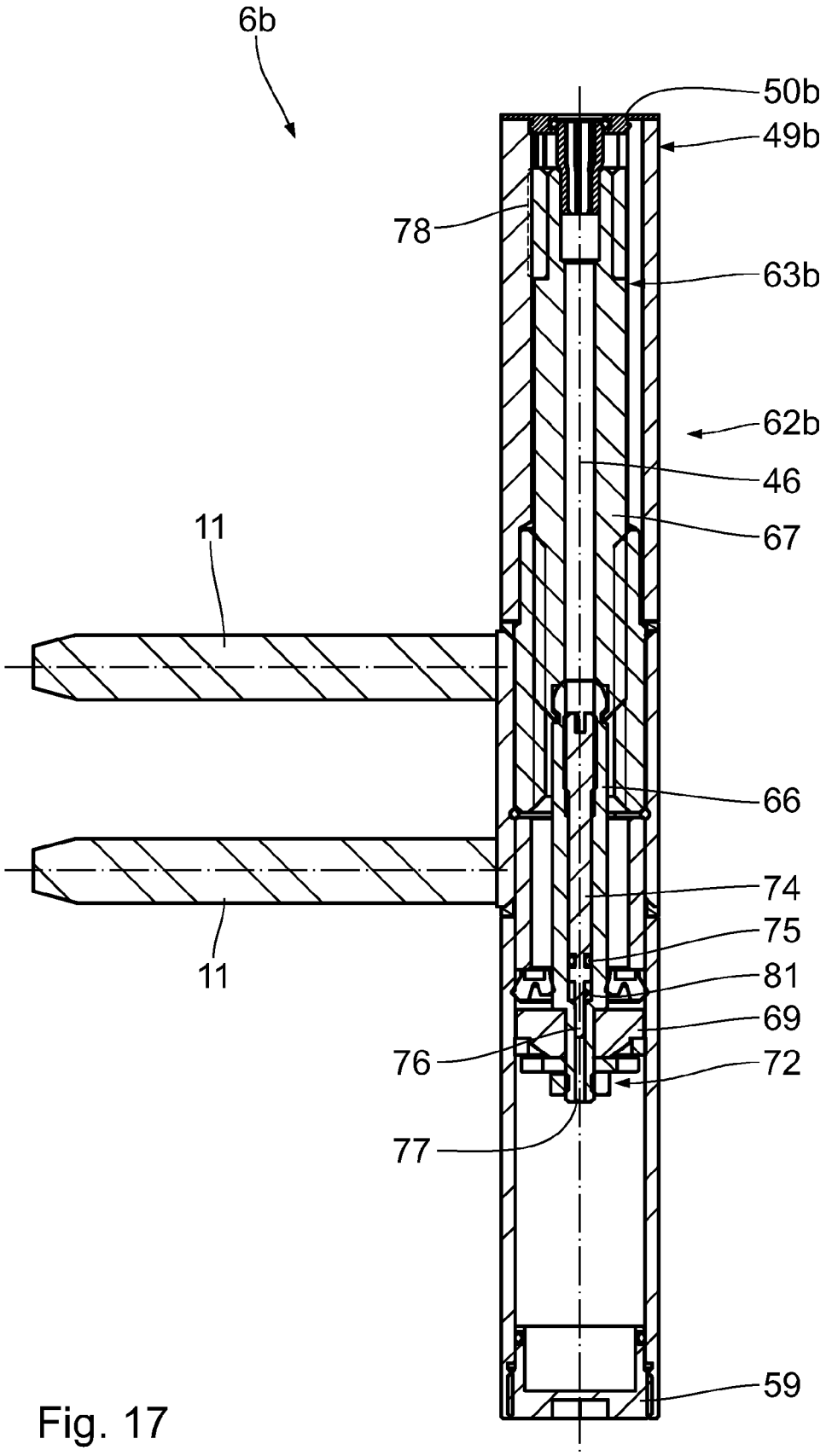
FIG. 17 is a longitudinal sectional view along the section line XVII-XVII in FIG. 16.
Figure 18:
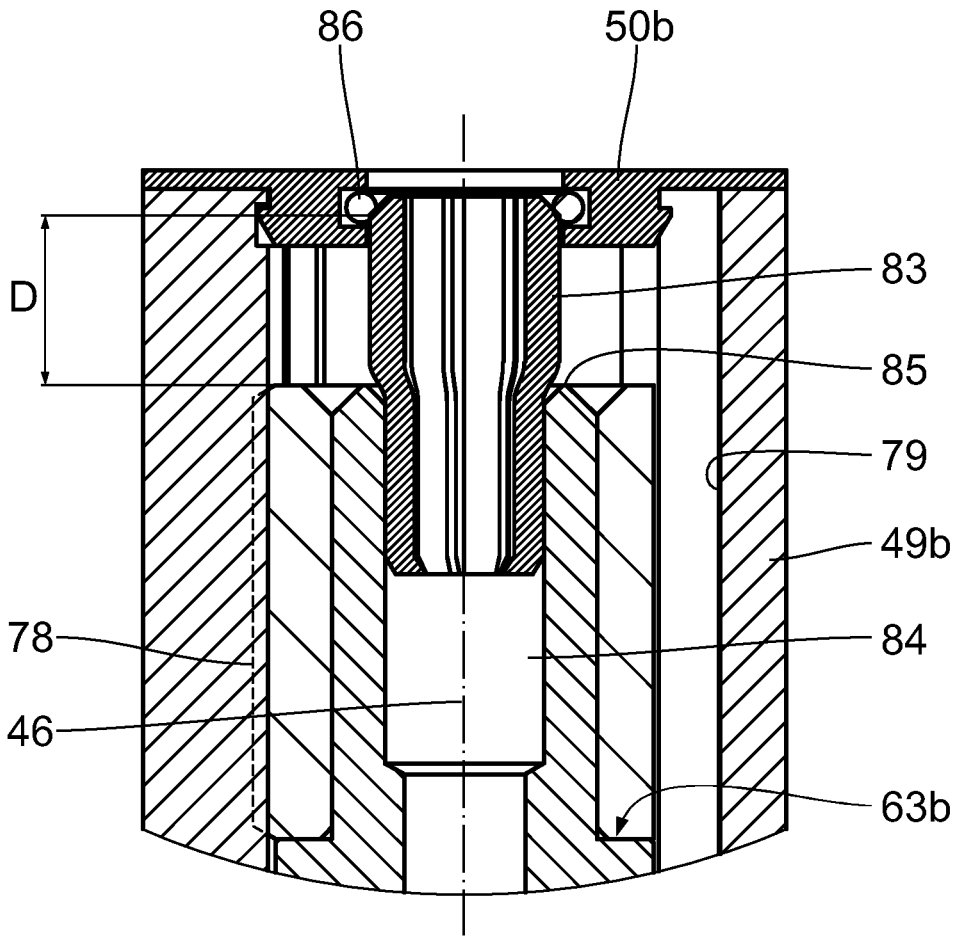
FIG. 18 is an enlarged detailed view according to FIG. 17.
Figure 19:
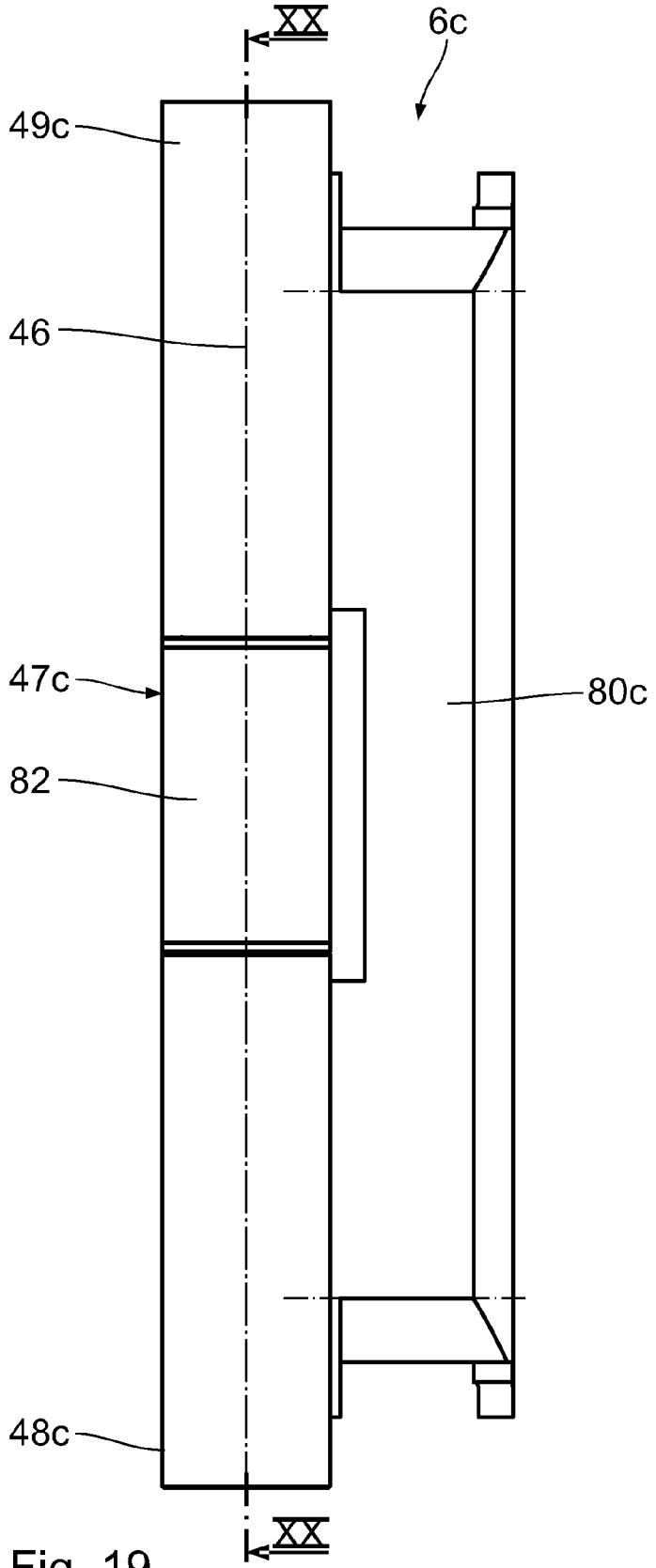
FIG. 19 is a side view of a damping hinge according to a fourth embodiment in a first position.
Figure 20:
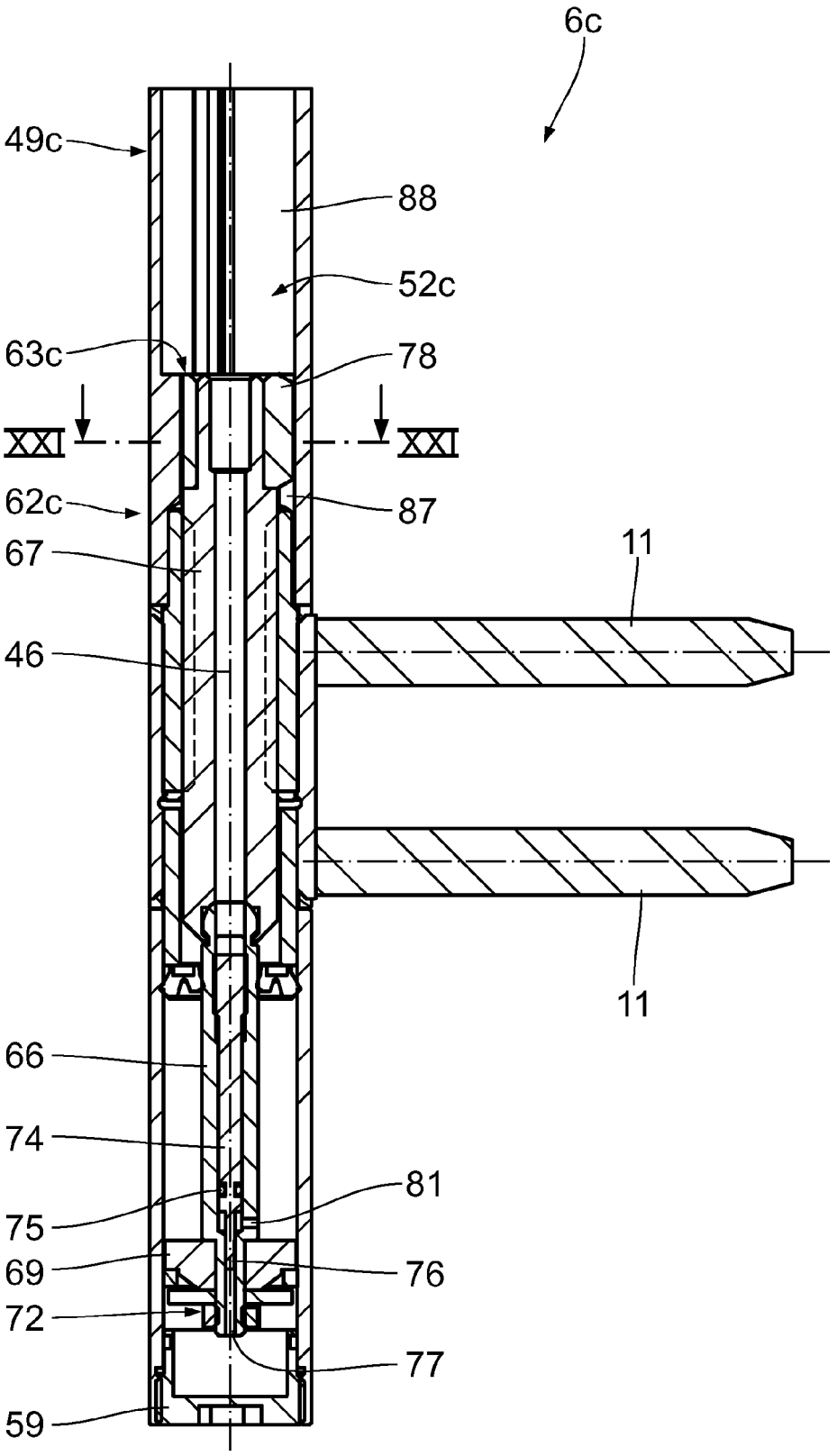
FIG. 20 is a longitudinal sectional view along the section line XX-XX in FIG. 19.
Figure 21:
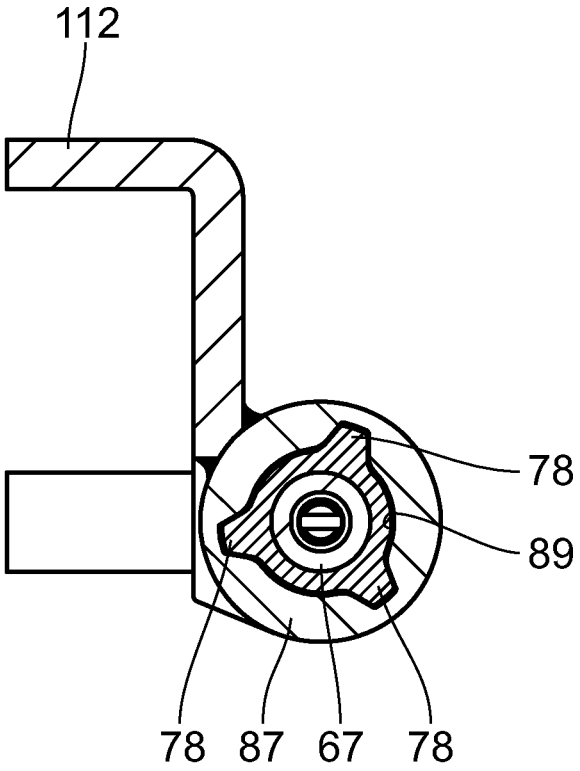
FIG. 21 is a cross-sectional view along the section line XXI-XXI in FIG. 20.
Figure 22:
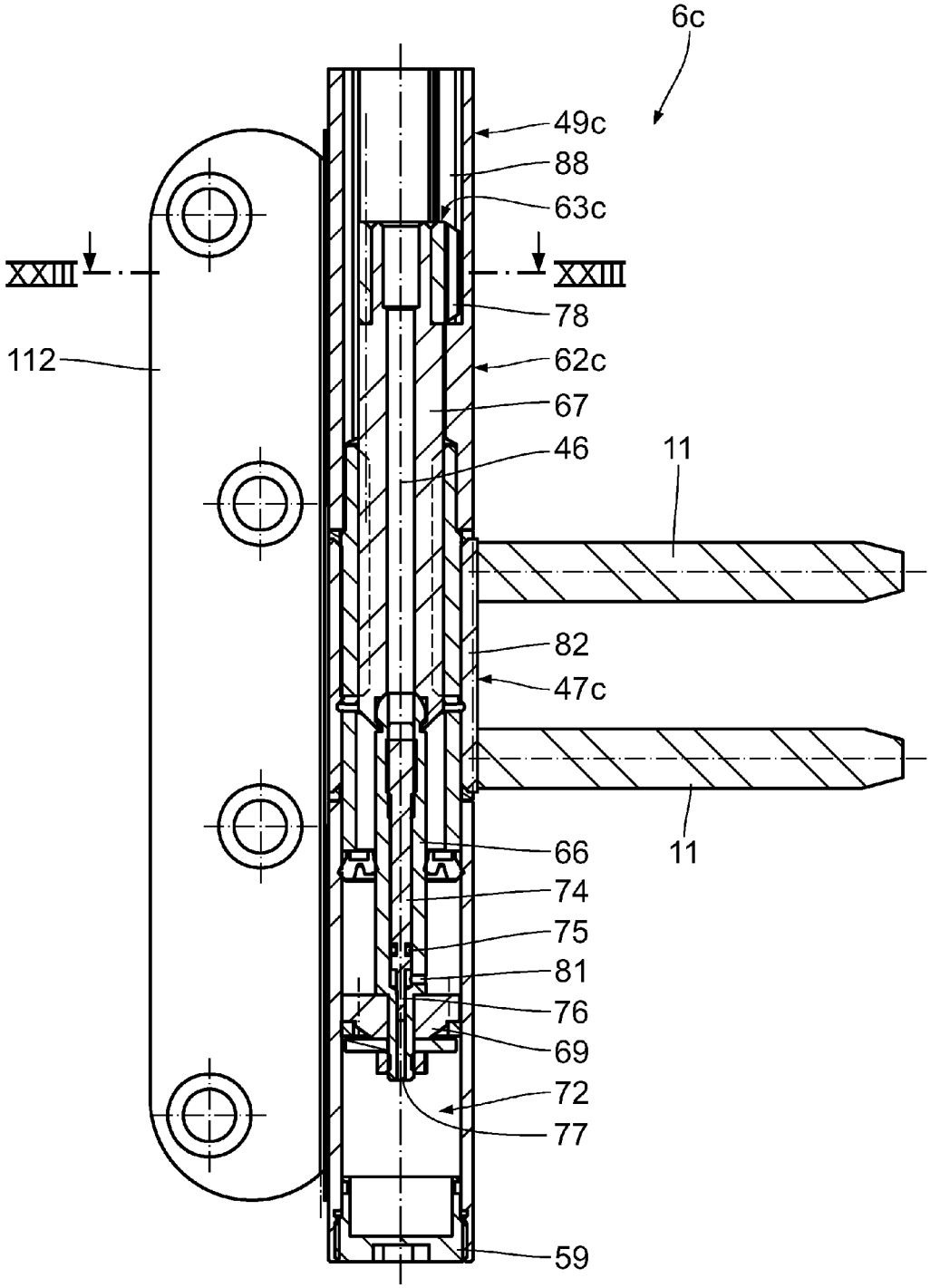
FIG. 22 is a longitudinal sectional view, corresponding to FIG. 20, of the damping hinge in a second position.
Figure 23:
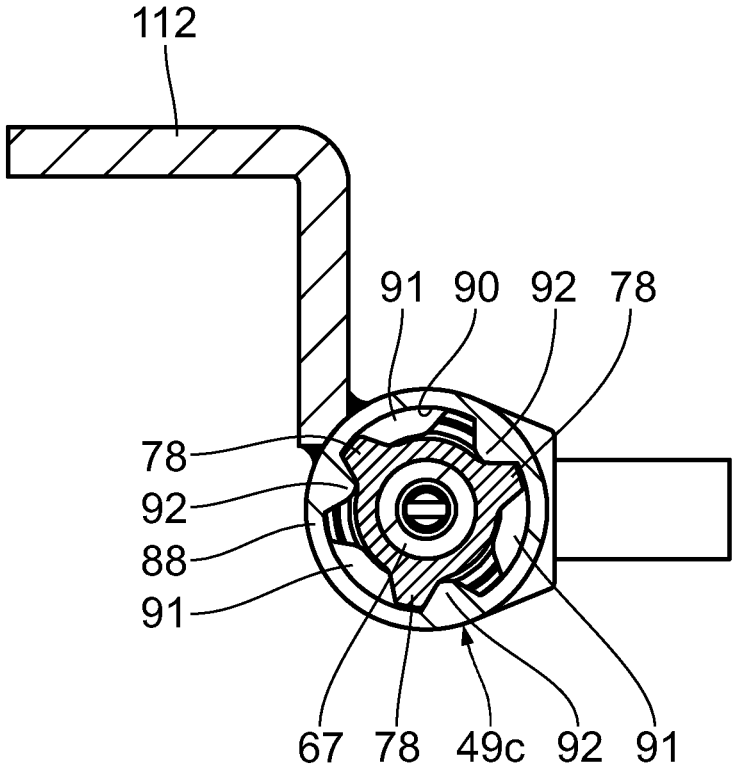
FIG. 23 is a cross-sectional view along the section line XXIII-XXIII in FIG. 22.

A third embodiment of the invention will be described below with reference to FIGS. 16 to 18. Structurally identical parts receive the same reference numerals as the two first embodiments, to the description of which reference is hereby made. Structurally different, but functionally similar parts receive the same reference numerals with a "b" placed thereafter.

An important difference compared to the damping hinge 6*a* is that the damping hinge 6*b* is configured as a three-part band. This means that the damping hinge housing 47*b* has a damping hinge housing lower part 48*b*, a damping hinge housing upper part 49*b* and a damping hinge housing center part 82 arranged between them. The housing lower part 48*b* and the housing upper part 49*b* are connected by a housing fastening 80*b* to the door frame 3. The damping hinge housing center part 82 is fastened by means of the fastening journal 11 to the door leaf 2.

The damping hinge 6*b*, like the damping hinge 6*a*, has a throttle function, which is ensured by the throttle rod 74 that can be displaced along the rotational axis 46. A further essential difference of the damping hinge 6*b* compared to the two first embodiments is that an opening limitation is provided. The opening limitation is ensured by a stop element 83, which is shown enlarged in FIG. 18. Upon a rotation of the door in the opening direction, because of the non-rotatable arrangement of the axial element 63, a displacement is made by means of the entrainer webs 78 along the rotational axis 46 axially upwardly toward the cover 50*b*. Since the stop element 83 is arranged in a recess 84 of the axial element 63*b* provided for this in such a way that the stop element 83 protrudes in the axial direction in an end face 85 of the axial element 63*b*, the stop element 83 comes into contact with the cover 50*b*, in particular with an O-ring 86 arranged in the cover 50*b*.

Since the stop element 83 rests on the O-ring 86, the axial displacement of the axial element 63*b* and therefore the opening movement of the damping hinge 6*b* are limited in total.

The opening limitation, i.e. a maximally possible opening angle, can be adjusted by the axial protrusion D of the stop element 83 along the rotational axis 46 on the end face 85. This is, for example, possible in that the stop element 83 can be screwed into the recess 84. The stop element 83 can also be glued or welded in the recess 84, in other words can be non-releasably connected to the axial element 63*b*. In particular, the stop element 83 is made of plastics material which has good damping properties.

A fourth embodiment of a damping hinge will be described below with reference to FIGS. 19 to 23. Structurally identical parts receive the same reference numerals as in the first three embodiments, to the description of which reference is hereby made. Structurally different, but functionally similar parts receive the same reference numerals with a "c" placed thereafter.

The damping hinge 6*c* is configured as a three-part band like the damping hinge 6*b* according to the second embodiment. The essential difference compared to the above-described embodiments is that the profile portion 52*c* provided in the damping hinge housing upper part 49*c* has an entraining portion 87 and a freely running portion 88 arranged in an adjacent manner along the rotational axis 46. The entraining portion 87 is configured in such a way that it has a cross-section, which is oriented perpendicular to the rotational axis 46 and has a non-round internal contour 89 with respect to the rotational axis 46. The non-round internal contour 89 corresponds with the external contour of the rotating entrainer arranged on the axial element 63*c*, which has three entrainer webs 78 directed radially outwardly along the outer periphery with respect to the rotational axis 46. Since the external contour of the rotating entrainer with the entrainer webs 78 corresponds to the internal contour 89, the axial element 63*c*, as long as it is arranged with the entrainer webs 78 in the entraining portion 87, is connected in a torque-transmitting manner, in other words non-rotatably, to the damping hinge housing upper part 49*c*.

The freely running portion 88 has a cross-section oriented perpendicular to the rotational axis 46, which also has a non-round internal contour 90. The internal contour 90 of the freely running portion 88 differs from the internal contour 89 of the entraining portion 87 in that freely running recess 91 are provided, which, in relation to a peripheral direction about the rotational axis 46 have a greater width than the entraining webs 78. According to the view in FIG. 23, the rotating entrainer is in each case arranged with the entrainer webs 78 resting on a contact face of a freely running recess 91 arranged viewed in the clockwise direction. This means that a displacement of the damping hinge housing upper part 49*c* in the anti-clockwise direction is possible, a rotation angle range being provided, in which no torque transmission from the housing upper part 49*c* to the rotating entrainer of the axial element 63*c* takes place. The torque transmission takes place firstly when the housing upper part 49*c* has been rotated until an entrainer projection 92 directed inwardly in each case with respect to the rotational axis between the freely running recesses 91 comes into contact with the next entrainer web 78 viewed anti-clockwise. According to the embodiment shown, the freely running rotation angle range is about 90°. The freely running rotation angle range, depending on the configuration of the internal contour 90 of the freely running portion 88 and the entrainer webs 78, can be adjusted to be larger or smaller.

Figure 24:
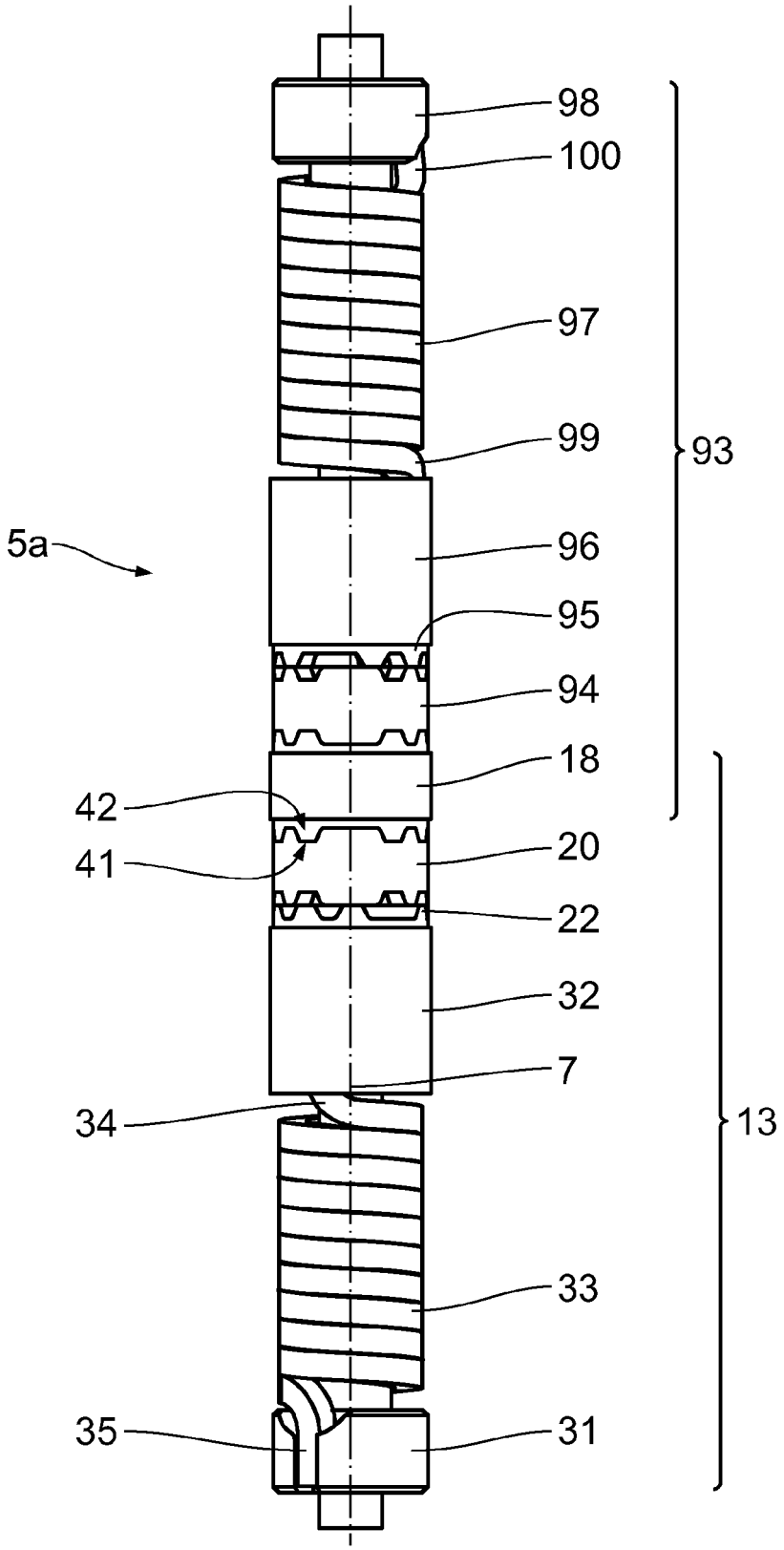
FIG. 24 is a view, corresponding to FIG. 5, of a closing hinge in accordance with a second embodiment in a closing arrangement.
Figure 25:
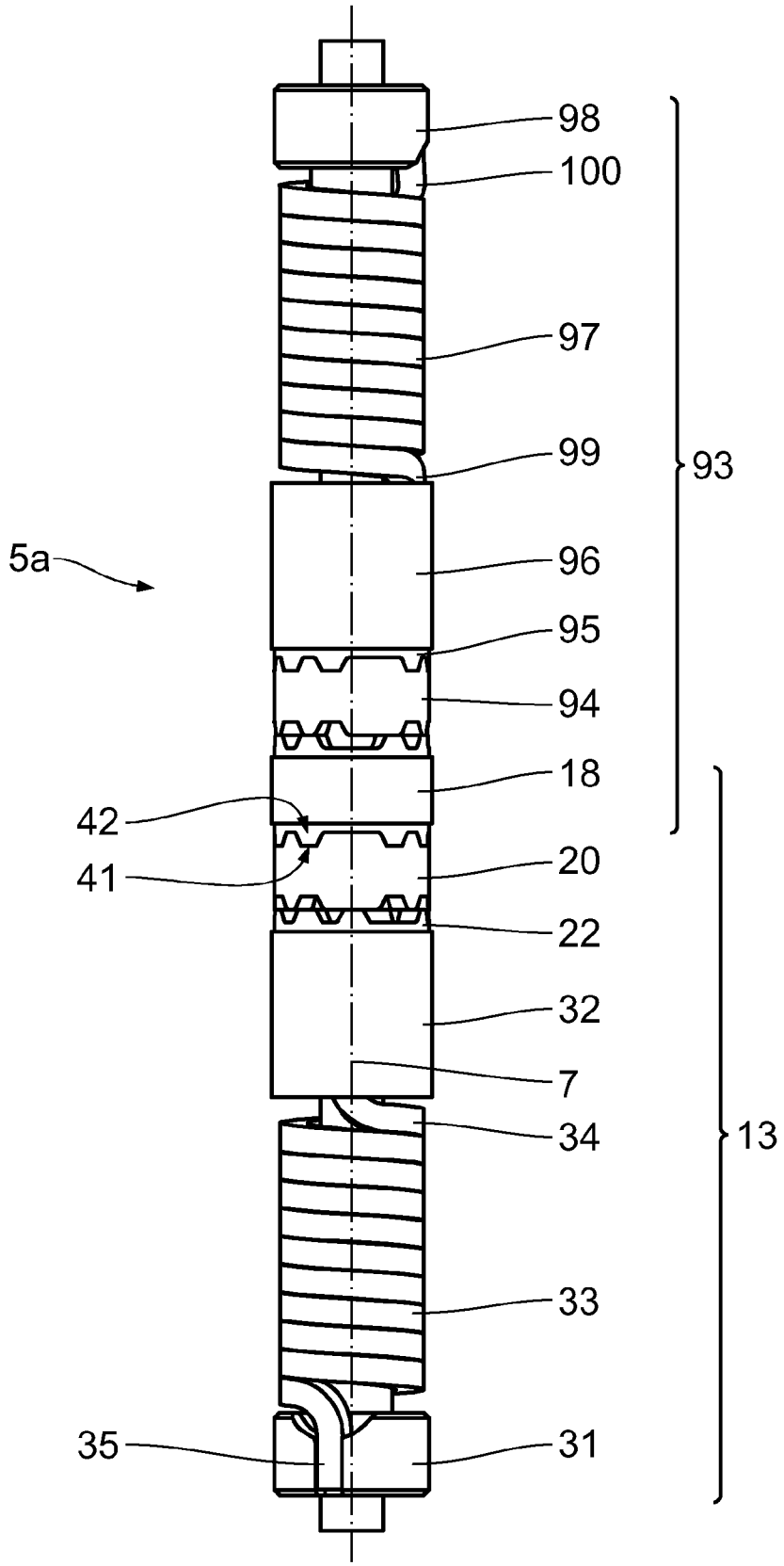
FIG. 25 is a view, corresponding to FIG. 24, of the closing hinge in a different closing arrangement.
Figure 26:
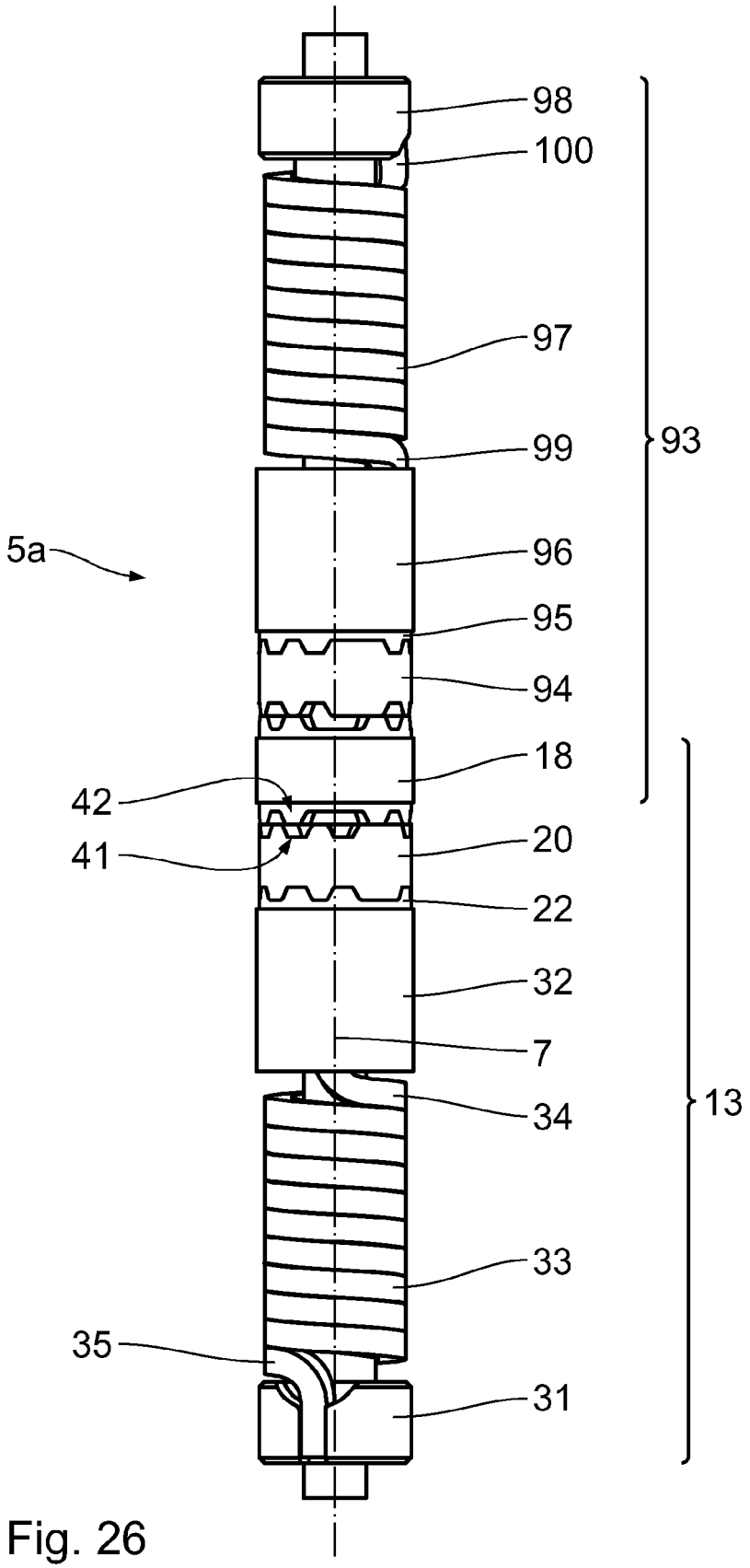
FIG. 26 is a view, corresponding to FIG. 24, of the closing hinge in a freely rotating arrangement.

With reference to FIGS. 24 to 26, a second embodiment of a closing hinge will be described below. Structurally identical parts receive the same reference numerals as in the first embodiment, to the description of which reference is hereby made. Structurally different, but functionally similar parts receive the same reference numeral with an "a" placed thereafter.

The essential difference of the closing hinge 5*a* according to the second embodiment compared to the closing hinge 5 according to the first embodiment is that the closing hinge 5*a* is configured as a three-part band.

The closing hinge 5*a* has a base plate 31, on which the torsion spring 33 is fastened by a second end 35. Furthermore, the torsion spring 33 is non-rotatably connected by a first end 34 arranged opposing the second end 35 to a closing drive element 32. Furthermore, a first parking element 22 and a first coupling element 20 that can be brought into engagement therewith are provided. The first coupling element 20 can furthermore be brought into engagement with the rotating drive element 18. For this purpose, the rotating drive element 18 and the first coupling element 20 have a mutual trapezoidal recess 41 or projections 42 according to the first embodiment of the closing hinge 5. The freely rotating closing unit 13 according to the second embodiment of the closing hinge 5*a* thus substantially corresponds to that of the first closing hinge 5 according to the first embodiment.

In addition, the closing hinge 5*a* has a second freely rotating closing unit 93, which, apart from the rotating drive element 18, has a second coupling element 94, a second parking element 95, a second closing drive element 96, a second torsion spring 97 and a second base plate 98. The second torsion spring 97 is fastened by a first end 99 on the second closing drive element 96 and by a second end 100 to the second base plate 98. With respect to the arrangement of the components along the center longitudinal axis 7, said components are arranged mirror-symmetrically with respect to the rotating drive element 18. In particular, only one rotating drive element 18 is provided, which is used to actuate both the first freely rotating closing unit 13 and also the second freely rotating closing unit 93.

The torsion springs 33, 97 are in each case configured as springs with a rectangular wire. It is also possible for at least one of the two springs 33, 97 to be produced as round wire.

Since the closing hinge 5*a* has an additional freely rotating closing unit 93, it is possible to provide an additional closing force, which brings about a closing of the door, in other words a movement of the door leaf 2 toward the door frame 3. In particular, the second freely rotating closing unit 93 can be adjusted in such a way that a closing force caused thereby only acts within a very small rotation angle range. This rotation angle range is in particular less than 10°, in particular less than 5° and in particular less than 2°. Fixing a small rotation angle range has the advantage that an increased closing torque, which is produced from the sum of the two individual closing torques, only has to be overcome at the beginning of an opening movement of the door. This ensures that an additional expenditure of force, which is necessary to overcome the closing force caused by the additional freely rotating closing unit 93, is small. At the same time, the additional closing force ensures that a secure closing of the door is ensured. This ensures, in particular, that an increased expenditure of force, which is necessary to overcome an actuation of a catch on a lock of the door, is provided. At the same time, it is ensured that a seal provided on the door is adequately pressed on.

In the view according to FIG. 24, the door is in a closed position, which means that the two freely rotating closing units 13, 93 exert a maximum closing force on the door leaf. FIG. 25 shows the closing hinge 5*a* in an arrangement rotated compared to FIG. 24. Since the door leaf 2 has been rotated in relation to the door frame 3, the rotating drive element 18 has been rotated with respect to the center longitudinal axis 7. Because of the differently configured end face profiles of the coupling elements 20, 94 or of the rotating drive element 18 and their respective arrangement with respect to one another, the torsion spring 33, shown at the bottom in FIG. 25, of the first freely rotating closing unit 13 is located, unchanged compared to FIG. 24, in a resetting position and exerts a spring force. On the other hand, the second coupling element 94 is axially displaced in relation to the rotating drive element 18 along the center longitudinal axis 7. The second coupling element 94 is parked on the second parking element 95. The second coupling element 94 is decoupled from the rotating drive element 18. The second freely rotating closing element 93, which is shown at the top according to FIG. 25, is in a freely rotating arrangement. This means that the freely rotating closing unit 93 in the arrangement according to FIG. 25 exerts no closing force on the door. According to the embodiment shown, the second freely rotating closing unit 93 shown at the top is thus used to apply the additional closing force.

FIG. 26 shows the closing hinge 5*a* in an arrangement which is rotated further in relation to the center longitudinal axis 7. In this arrangement, both the first freely rotating closing unit 13 and the freely rotating closing unit 93 are arranged in a parking arrangement, which means that the rotating drive element 18 is decoupled from the two coupling elements 20, 94. The two coupling elements 20, 94 are parked at the respective parking element 22 or 95. In this arrangement, the door leaf 2 can be pivoted in relation to the door frame 3 without an additional exertion of force, i.e. without an additionally acting closing force or closing torque. The rotation angle ranges, within which the first freely rotating closing unit 13 and the second freely rotating closing unit 93 are active, can be adjusted independently of one another.

A third embodiment of a closing hinge will be described below with reference to FIGS. 27 to 40. Structurally identical parts receive the same reference numerals as in the two first embodiments, to the description of which reference is hereby made. Structurally different, but functionally similar parts receive the same reference numerals with a "b" placed thereafter.

The closing hinge 5*b* according to the third embodiment substantially corresponds to the closing hinge 5*a* according to the second embodiment, the activation or deactivation of the freely rotating closing units, 13*b*, 93*b* being realized by means of a so-called roller coupling. For this purpose, a first coupling element 20*b* and a second coupling element 94*b* are provided, which are in each case configured in a sleeve-like manner with two respective elongate holes 101, 102. The elongate holes 101, 102 are in each case arranged on an outer cylindrical lateral surface of the respective coupling element 20*b*, 94*b* and oriented parallel to the center longitudinal axis 7. In relation to the center longitudinal axis 7, the elongate holes 101, 102 are arranged in a diametrically opposing manner on the respective coupling element 20*b*, 94*b*. The elongate holes 101, 102 are in each case configured to be open toward an end remote from the base plates 31, 98.

The coupling elements 20*b*, 94*b* are in each case non-rotatably connected to the corresponding torsion spring 33, 97. Arranged concentrically with respect to the center longitudinal axis 7 is a rod 113 with a parking element 22*b*. The parking element 22*b* is fastened on the rod 113 and, in particular non-rotatably connected to the rod 113. The rod 113, in particular the parking element 22*b* is non-rotatably connected to the fastening 112 by means of the closing hinge housing center part 104. The parking element 22*b* has a central cylindrical portion, which is substantially fitted into the sleeve-like recesses of the coupling elements 20*b*, 94*b*. At an outer cylindrical lateral surface, the parking element 22*b* has two elongate hole grooves 103 extending parallel to the center longitudinal axis 7. The elongate hole grooves 103 are arranged in a diametrically opposing manner with respect to the center longitudinal axis 7 on the parking element 22*b*. The elongate hole grooves 103 have a limited depth. In a sectional plane perpendicular to the center longitudinal axis 7, the elongate hole grooves 103 have a curved, in particular are of a circle-like contour.

Figure 27:
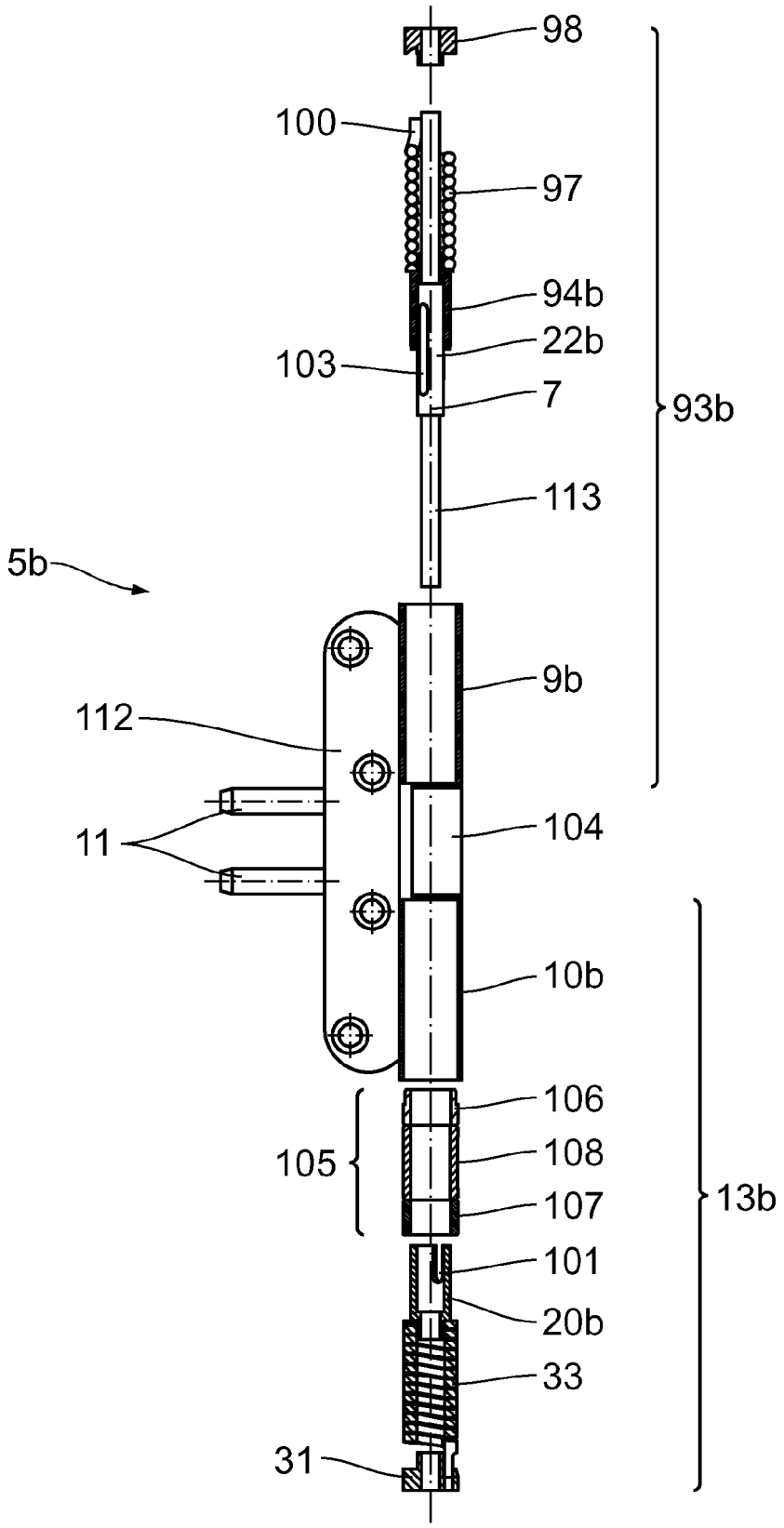
FIG. 27 is a longitudinal section of an exploded view of a closing hinge according to a third embodiment.
Figure 28:
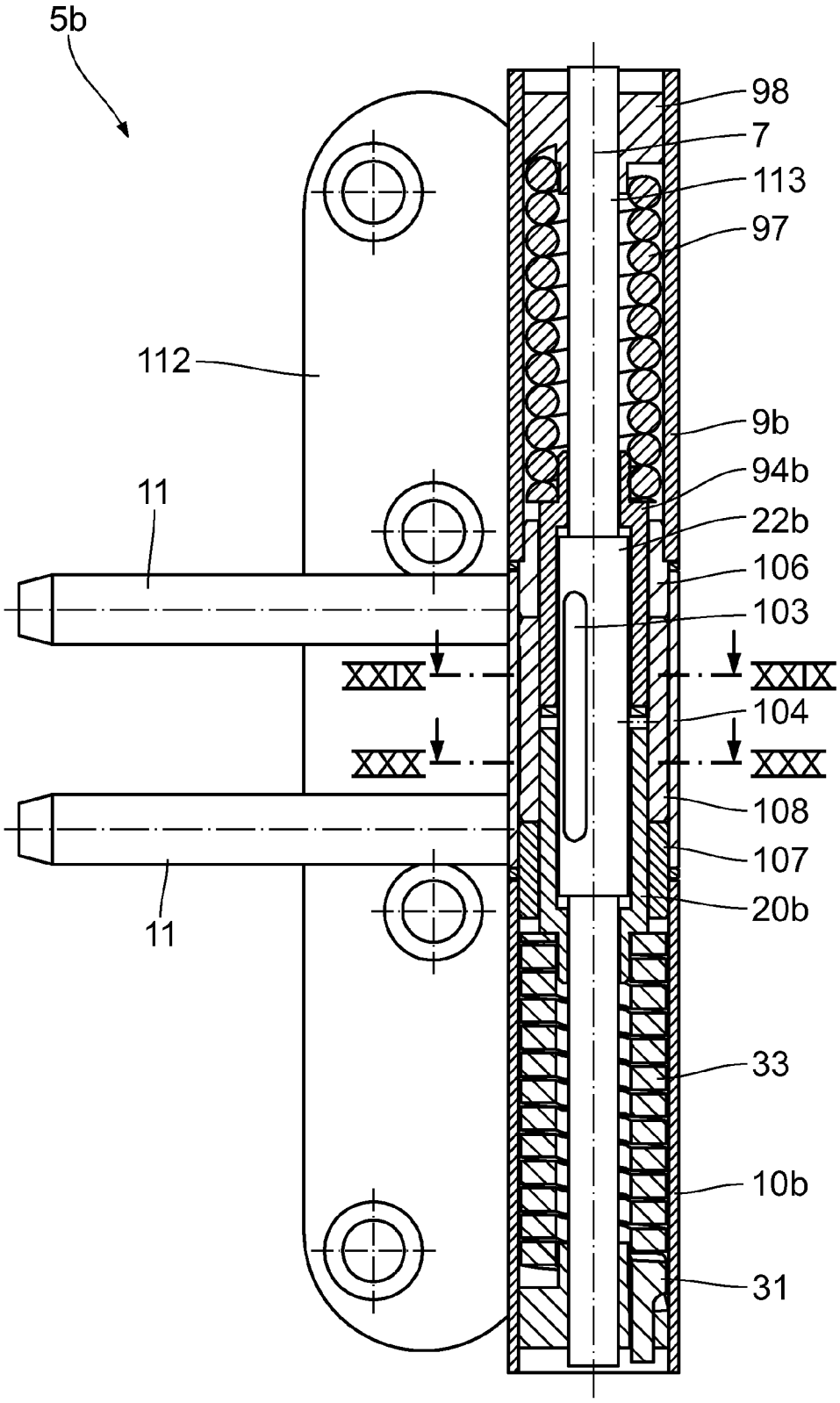
FIG. 28 is a longitudinal sectional view of the closing hinge according to FIG. 27 in the assembled state.

According to the view in FIG. 27, the torsion spring 97 is produced from round wire and the torsion spring 33 from rectangular wire. Basically, it is also possible to produce the two springs 33, 97 from identical wire. With a different selection of the spring material, a different adjustment of the closing force brought about thereby is possible in a better manner.

The closing hinge 5*b* has a closing hinge housing upper part 9*b* and a closing hinge housing lower part 10*b* and a closing hinge housing center part 104 arranged in between. Provided in the closing hinge housing center part 104 is a multi-part sleeve arrangement 105, with an upper entrainer sleeve 106, a lower entrainer sleeve 107 and a rotating sleeve 108 arranged in between.

The rotating sleeve 108 is used, on the one hand, as an axial spacer between the two entrainer sleeves 106, 107. On the other hand, the rotating sleeve 108 is non-rotatably connected to the closing hinge housing center part 104. The rotating hinge 108 allows a torque transmission from the closing hinge housing center part 104 to the coupling elements 20*b*, 94*b*. The rotating sleeve 108 has elongate hole grooves 109, 110 arranged parallel to the center longitudinal axis 7, the elongate hole grooves 109 or 110 in each case being arranged pairwise with respect to one another in a diametrically opposing manner with respect to the center longitudinal axis 7 on the rotating sleeve 108.

The elongate hole 101 of the first coupling element 20*b* and the elongate hole 102 of the second coupling element 94*b* are used for guidance of cylindrical rollers 111 arranged parallel to the center longitudinal axis 7. Instead of the rollers 111, a plurality of balls arranged parallel to the center longitudinal axis 7 can also be used. The rollers 111 have increased strength compared to ball arrangements of this type.

Figure 30:
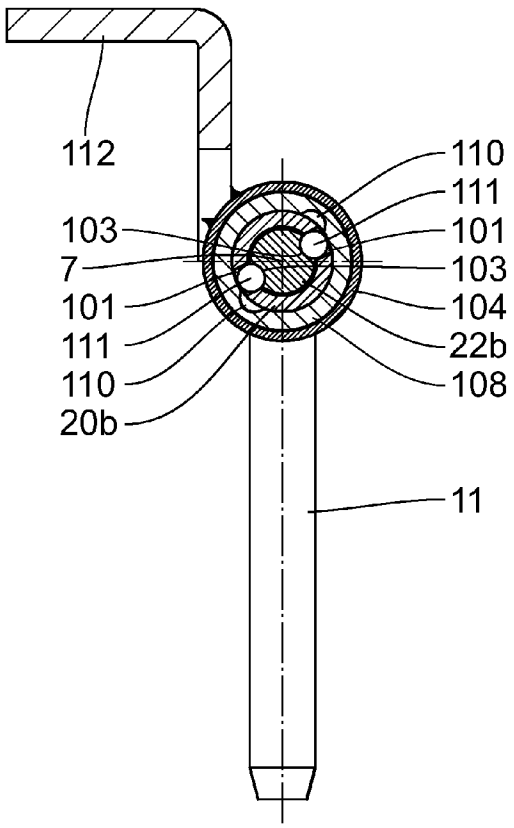
FIG. 30 is a cross-sectional view along the section line XXX-XXX in FIG. 28.
Figure 29:
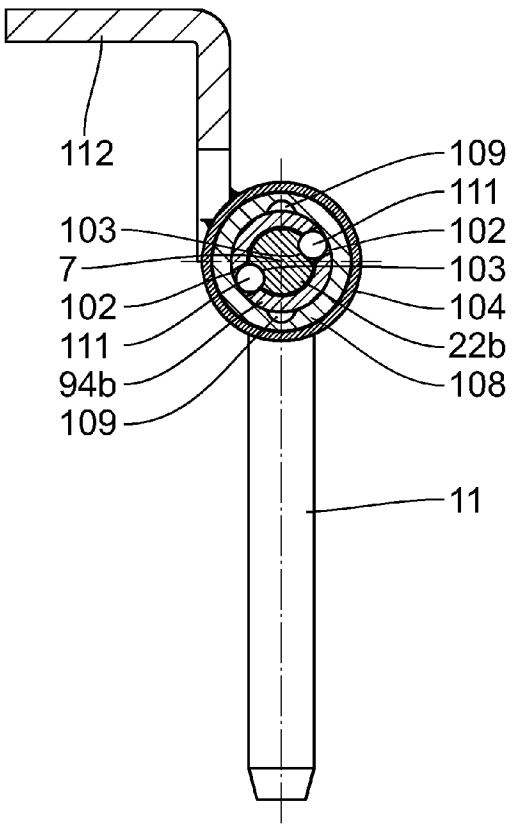
FIG. 29 is a cross-sectional view along the section line XXIX-XXIX in FIG. 28.

The function of the closing hinge 5*b* will be described in more detail below with the aid of FIGS. 29 to 40. FIG. 29 shows a cross-section perpendicular to the center longitudinal axis 7 through the second coupling element 94*b*, which is shown at the top in FIGS. 27, 28. Accordingly, FIG. 30 shows a cross-section through the first coupling element 20*b*, which is shown at the bottom in FIGS. 27, 28. The two coupling elements 20*b*, 94*b* are substantially configured in such a way that they substantially surround the parking element 22*b*. Proceeding from an arrangement in FIGS. 29 and 30, in which the door is opened, the torsion springs 33, 97 are parked on the parking element 22*b*. This means that the two torsion springs 33, 97 exert no closing force on the door. For this purpose, the rollers 111 are arranged in the elongate hole grooves 103, provided for this, of the parking element 22*b*. At the same time, the rollers 111 are arranged in the elongate holes 102 of the second coupling element 94*b* and in the elongate holes 101 of the first coupling element 20*b*.

Figure 32:
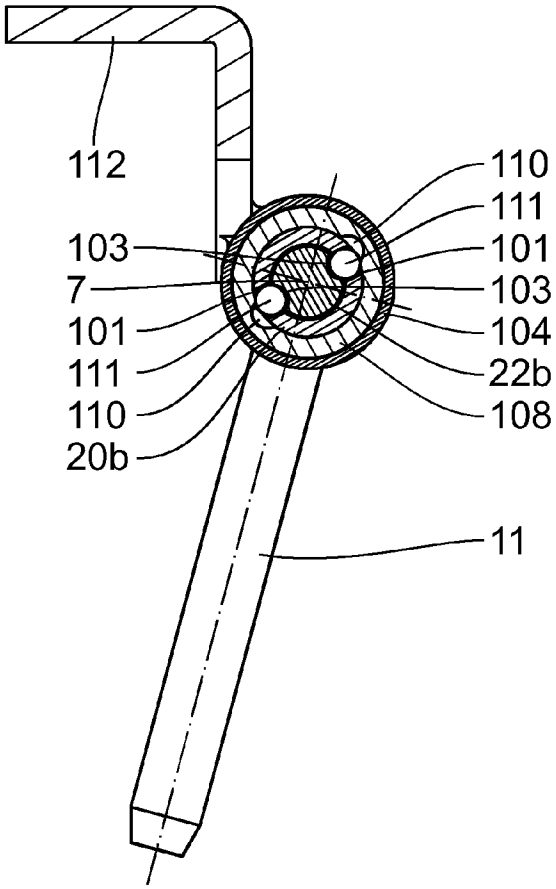
FIG. 32 is a sectional view, corresponding to FIGS. 29 and 30, of the closing hinge in another rotating arrangement.
Figure 31:
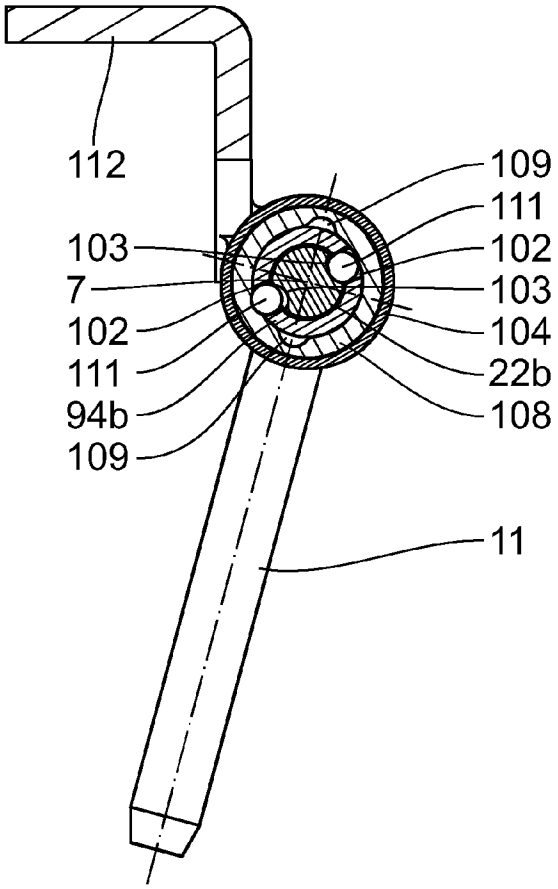
FIG. 31 is a sectional view, corresponding to FIGS. 29 and 30, of the closing hinge in one rotating arrangement.

According to FIGS. 29, 30, the door is opened and arranged in the freely rotating arrangement, i.e. the leaf is pivoted open by 90° in relation to the door frame. Upon a closing movement, the door leaf is now pivoted toward the door frame, the door frame being fastened to an angular housing fastening 112 and the door leaf being fastened on the fastening journals 11. Upon a pivoting movement of the door leaf, the fastening journals 11 are rotated in relation to the center longitudinal axis 7 together with the closing hinge housing center part 104. A correspondingly rotated state is shown in FIGS. 31, 32. Owing to the rotation of the closing hinge housing center part 104, the rotating sleeve 108 non-rotatably connected thereto is also rotated. Correspondingly, the elongate hole grooves 109, 110 are displaced with respect to their rotational position relative to the center longitudinal axis 7 toward the rollers 111. Upon a further rotation of the door leaf and therefore of the closing hinge housing center part 104, an arrangement is produced in such a way that the elongate hole grooves 110, the elongate holes 101 and the elongate hole grooves 103 are arranged radially aligned with one another with respect to the center longitudinal axis 7. In this arrangement, the rollers 111 are displaced radially outwardly from the elongate hole grooves 103 of the parking element 22*b* into the elongate hole grooves 110 of the rotating sleeve 108.

Since the two coupling elements 20*b*, 94*b*, on opening, are tensioned by the respective torsion springs 33 or 97 by the rotating movement of the door leaf 2, the torsion springs 33, 97 and therefore the coupling elements 20*b*, 94*b* non-rotatably connected thereto are pretensioned with a torque in the opened position of the door. The parking element 22*b* pretensioned by the rod 113, with the elongate hole grooves 103, in each case exerts a torque on the rollers 111. As the elongate hole grooves 103 in each case have a curved contour, the rollers 111 are pressed radially outwardly with respect to the center longitudinal axis 7 during the entire closing process of the door. As long as the elongate hole grooves 109, 110 do not align with the elongate holes 101, 102, the radial movement of the rollers 111 is blocked by the rotating sleeve 108.

Figure 34:
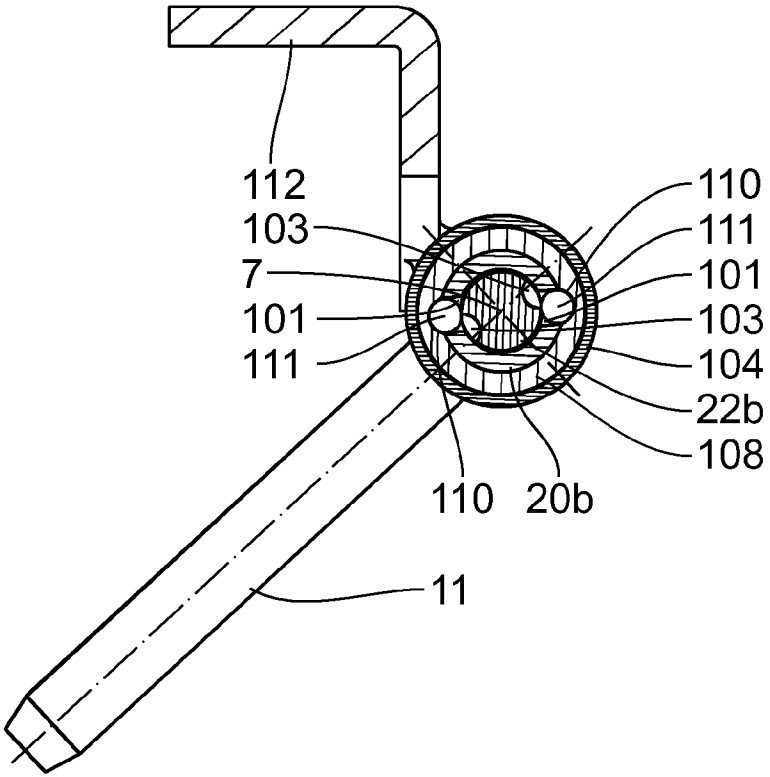
FIG. 34 is a sectional view, corresponding to FIGS. 29 and 30, of the closing hinge in yet another rotating arrangement.
Figure 33:
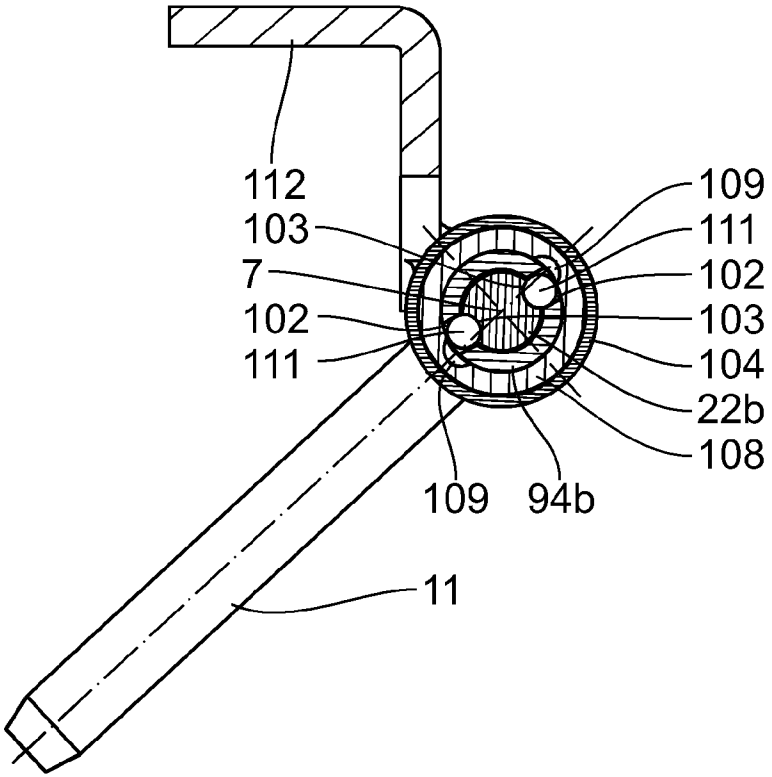
FIG. 33 is a sectional view, corresponding to FIGS. 29 and 30, of the closing hinge in yet another rotating arrangement.
Figure 36:
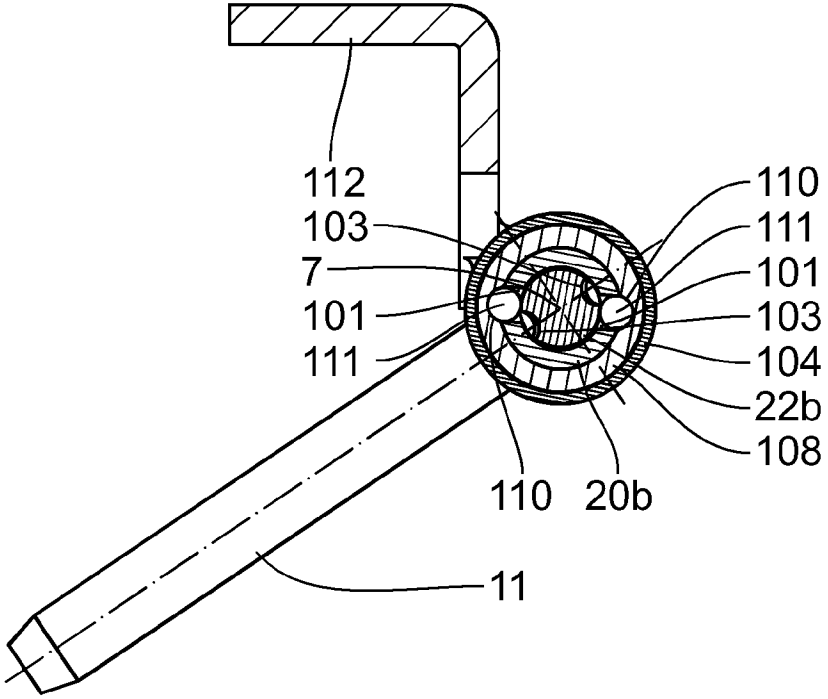
FIG. 36 is a sectional view, corresponding to FIGS. 29 and 30, of the closing hinge in yet another rotating arrangement.
Figure 35:
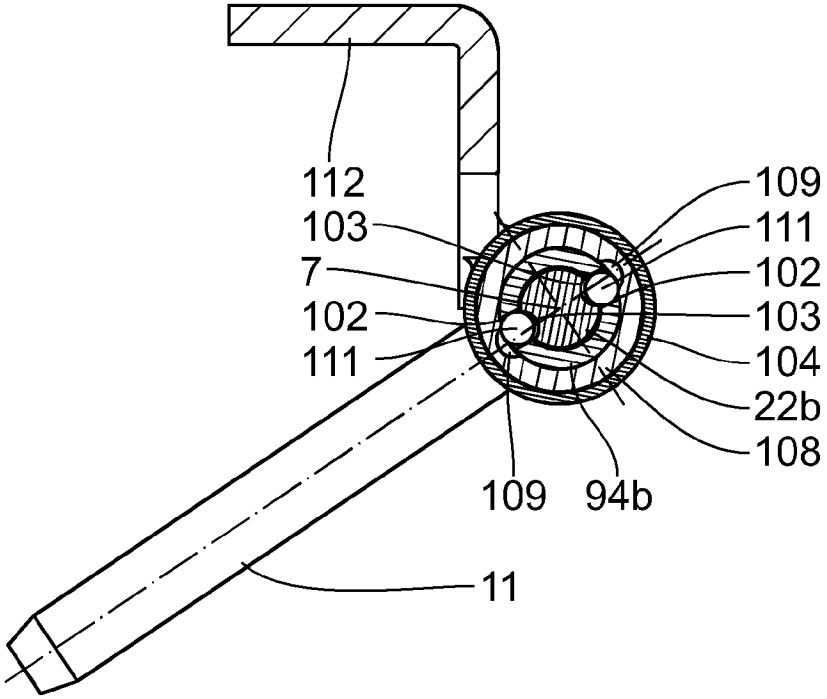
FIG. 35 is a sectional view, corresponding to FIGS. 29 and 30, of the closing hinge in yet another rotating arrangement.
Figure 37:
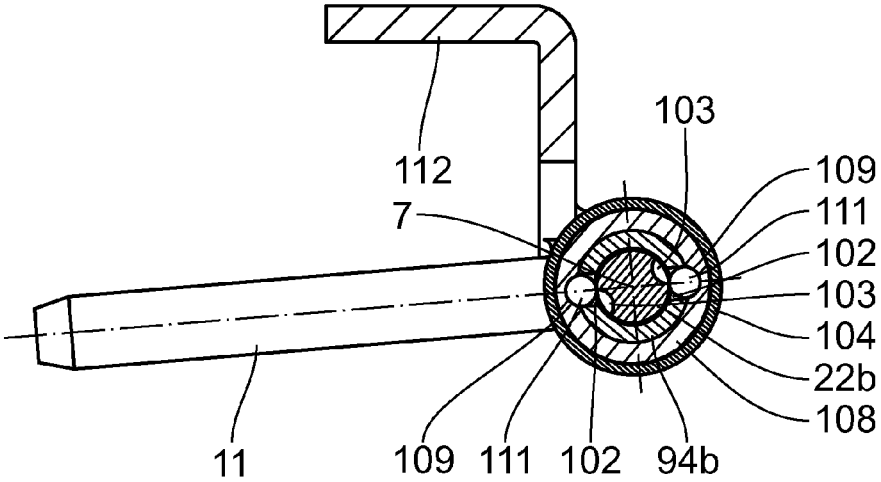
FIG. 37 is a sectional view, corresponding to FIGS. 29 and 30, of the closing hinge in yet another rotating arrangement.
Figure 38:
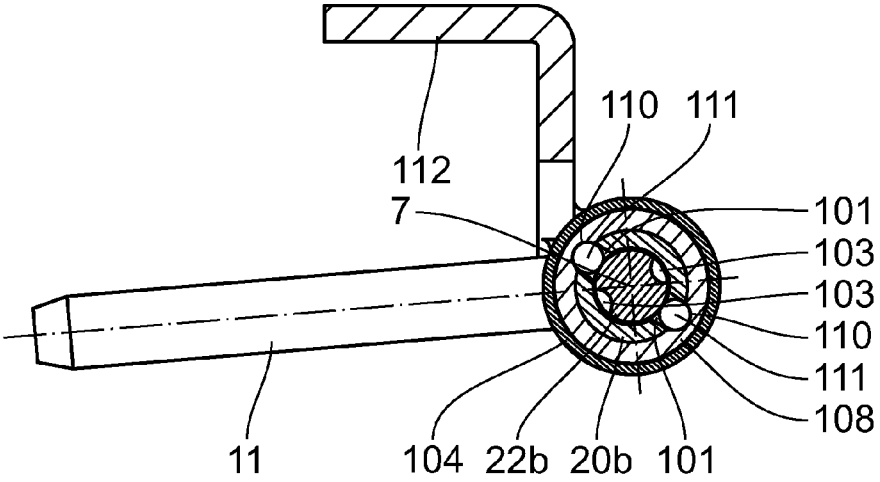
FIG. 38 is a sectional view, corresponding to FIGS. 29 and 30, of the closing hinge in yet another rotating arrangement.
Figure 39:
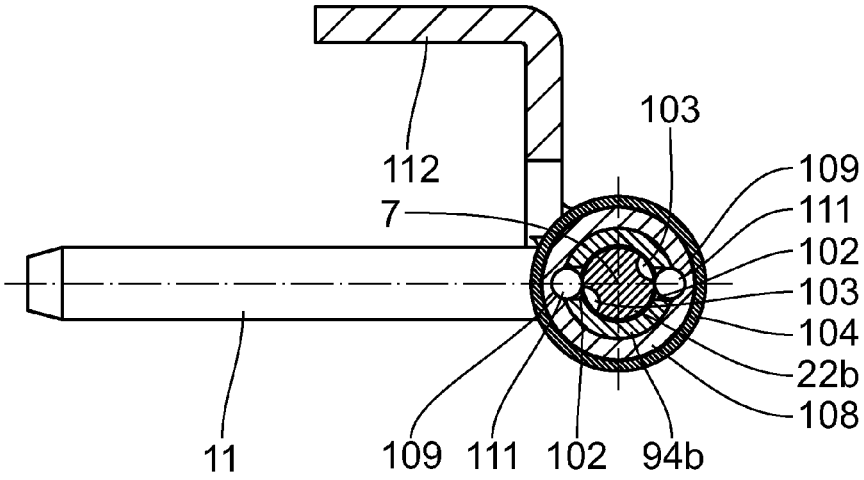
FIG. 39 is a sectional view, corresponding to FIGS. 29 and 30, of the closing hinge in yet another rotating arrangement.
Figure 40:
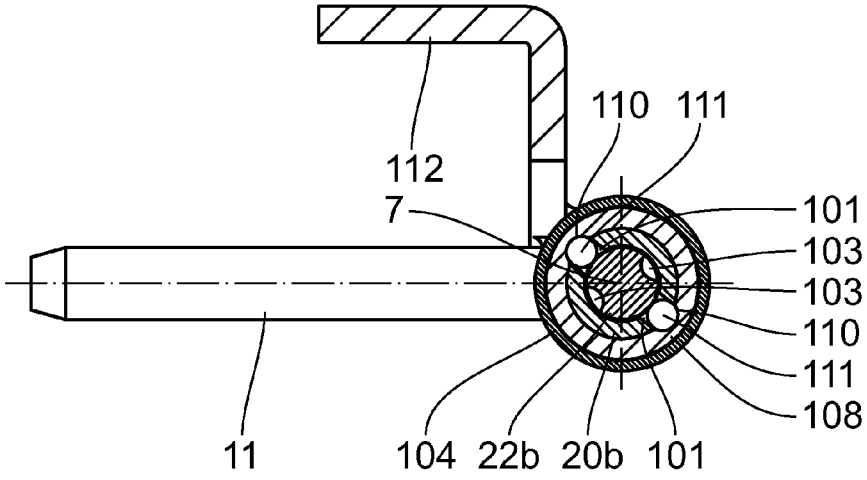
FIG. 40 is a sectional view, corresponding to FIGS. 29 and 30, of the closing hinge in yet another rotating arrangement.

A corresponding arrangement is shown in FIG. 34. The door leaf is pivoted by about 45° in relation to the door frame. Since the rollers 111 are now no longer arranged in the elongate hole grooves 103 of the parking element 22*b*, but in the elongate hole grooves 110 of the rotating sleeve 108, the rotating sleeve 108 is connected in a torque-transmitting manner to the first coupling element 20*b*. This means that, in the view according to FIG. 34, the first torsion spring 33 is activated by the rotating sleeve 108 and the first coupling element 20*b*. This means that the first torsion spring 33 is no longer parked. The first torsion spring 33 brings about a closing force on the door. On the other hand, in the rotation angle arrangement shown, the second spring 97 is still deactivated, as the rollers 111, as shown in FIG. 33, are arranged in the elongate hole grooves 103 of the parking element 22*b*. Upon a further rotation of the door leaf and therefore of the closing hinge housing center part 104, the rollers 111 can be pressed radially outwardly into the elongate hole grooves 109 provided for this of the rotating sleeve 108. An arrangement of this type is shown in FIG. 37. An opening angle of the door according to FIG. 37 is about 5°. In this arrangement, the second torsion spring 97 is additionally also activated and brings about an additional closing force on the door analogously to the closing hinge 5*a* according to the second embodiment.

Since the elongate hole grooves 109 and 110 are arranged offset with regard to their peripheral position with respect to the center longitudinal axis 7, the torsion springs 33, 97 are deactivated or activated at different times, i.e. at different rotation angles.

Upon an opening movement of the door, the deactivation of the torsion springs 97, 33 takes place in the correspondingly reversed order, the two torsion springs 97, 33 being firstly activated and the second torsion spring 97 firstly being deactivated followed by the first torsion spring 33 by displacing the rollers 111 from the elongate hole grooves 109, 110 into the elongate hole grooves 103 of the parking element 22*b*. The deactivation of the torsion springs 33, 97 takes place in that, when the door is opened, the torsion springs 33, 97 are firstly tensioned because of the rotating movement of the door leaf 2 with the fastening 112. Accordingly, the rotating sleeve 108 is also rotated in relation to the parking element 22*b*. The rollers 111 are arranged in the elongate hole grooves 109, 110 of the rotating sleeve 108 and in the elongate holes 101, 102 of the coupling elements 20*b*, 94*b*. Owing to the rotation of the rotating sleeve 108, the coupling elements 20*b*, 94*b* are entrained by the rollers 111 and the torsion springs 33, 97 are therefore pretensioned. Because of the increasing pretensioning during the rotating movement and the curved contour of the elongate hole grooves 109, 110, a force acting radially inwardly with respect to the center longitudinal axis 7 is exerted on the rollers 111. Because of the cylindrical lateral surface of the parking element 22*b*, the rollers are prevented from making the radial movement inwardly. Only when the elongate hole grooves 103 are aligned with the elongate holes 101, 102 in the radial direction, can the rollers 111 be displaced radially inwardly into the elongate hole grooves 103 of the parking element 22*b*.

Figure 41:
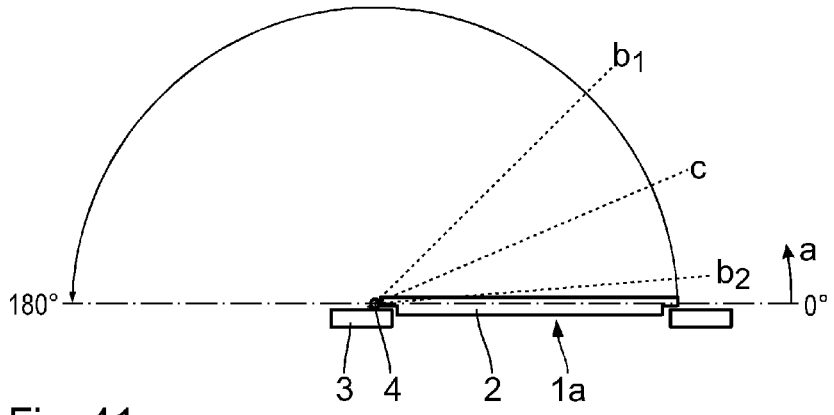
FIG. 41 is a view, corresponding to FIG. 12, of a door arrangement with a closing hinge according to the third embodiment and a damping hinge according to the second embodiment.
Figure 42:
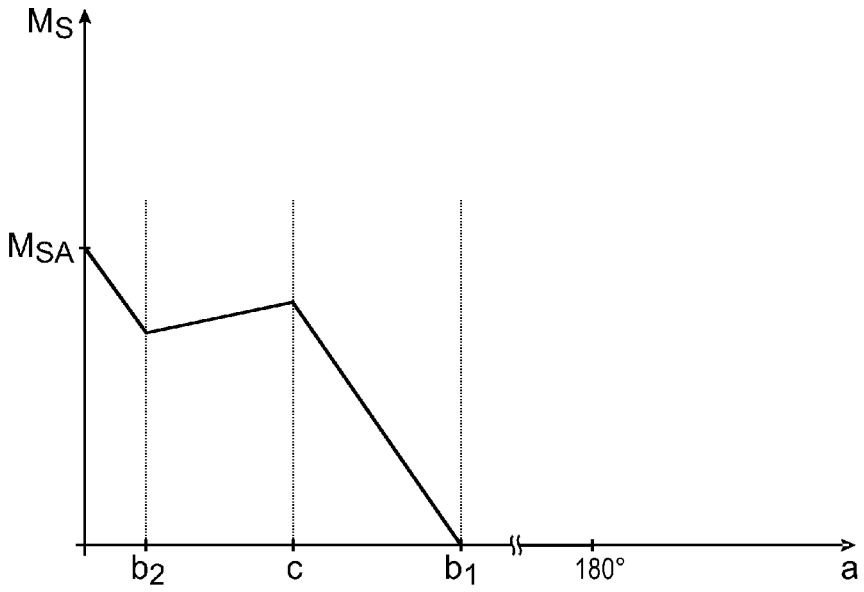
FIG. 42 is a view, corresponding to FIG. 13, for a door arrangement according to FIG. 41.
Figure 43:
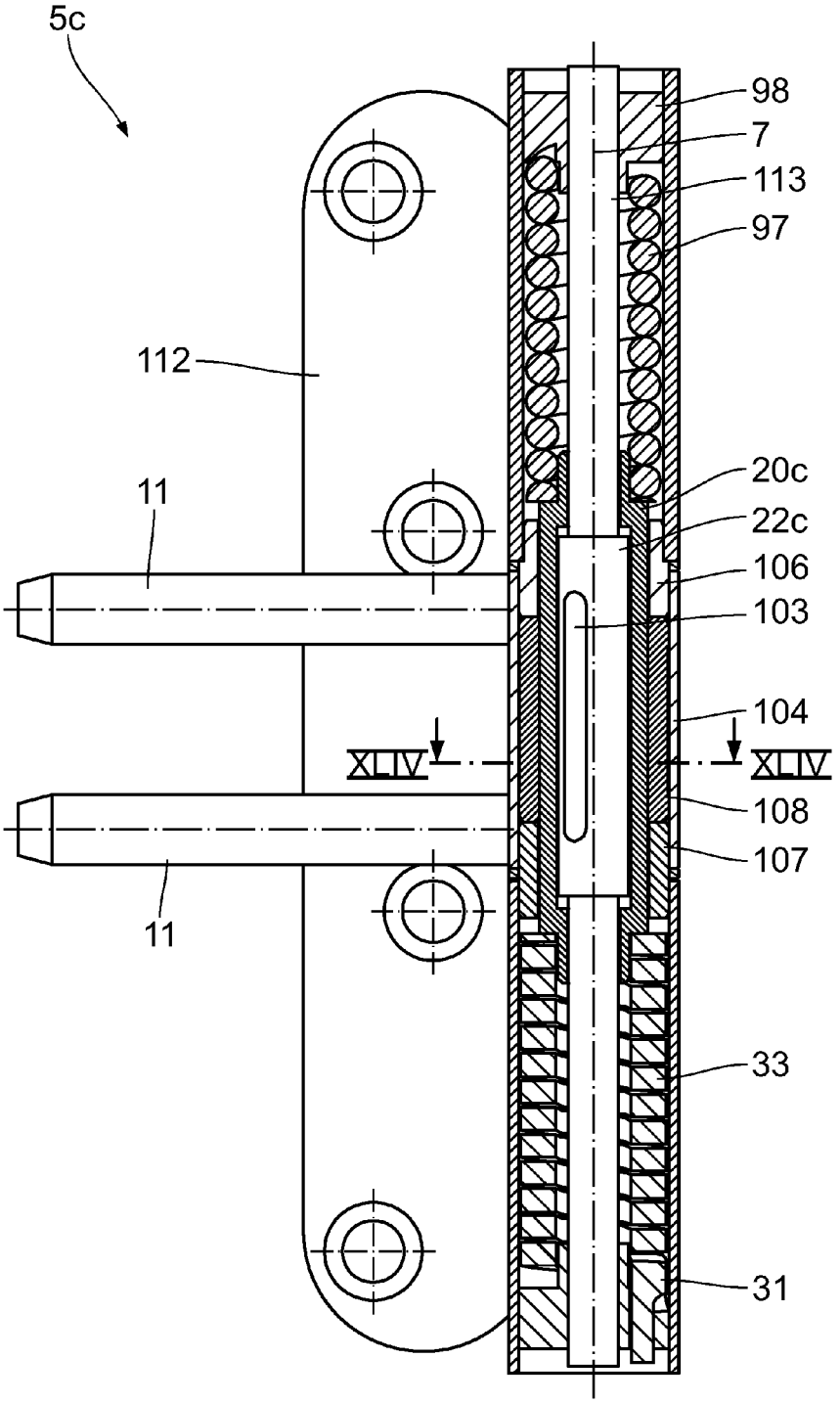
FIG. 43 is a view, corresponding to FIG. 28, of a closing hinge according to a fourth embodiment.
Figure 45:
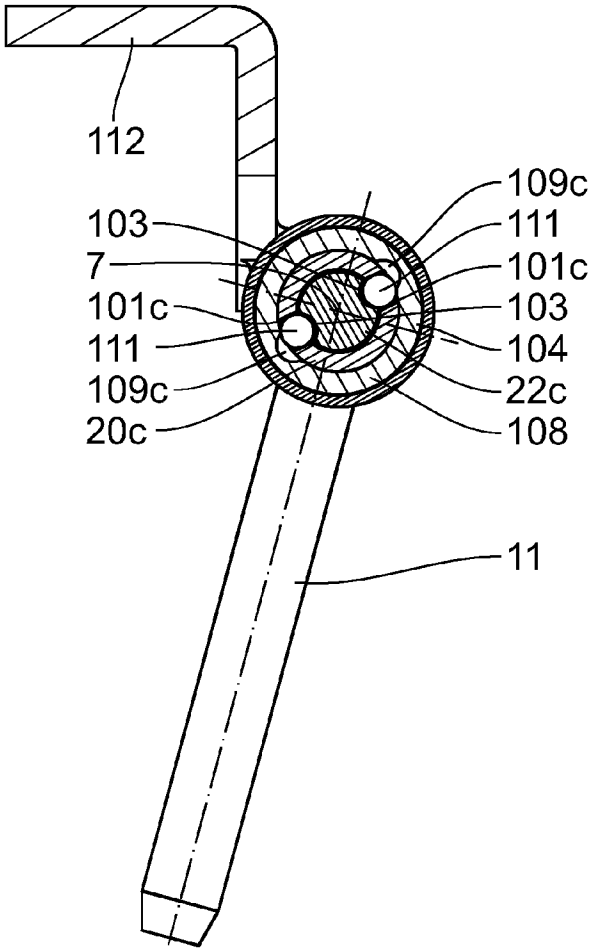
FIG. 45 is a sectional view, corresponding to FIG. 44, of the closing hinge in one rotating arrangement.
Figure 44:
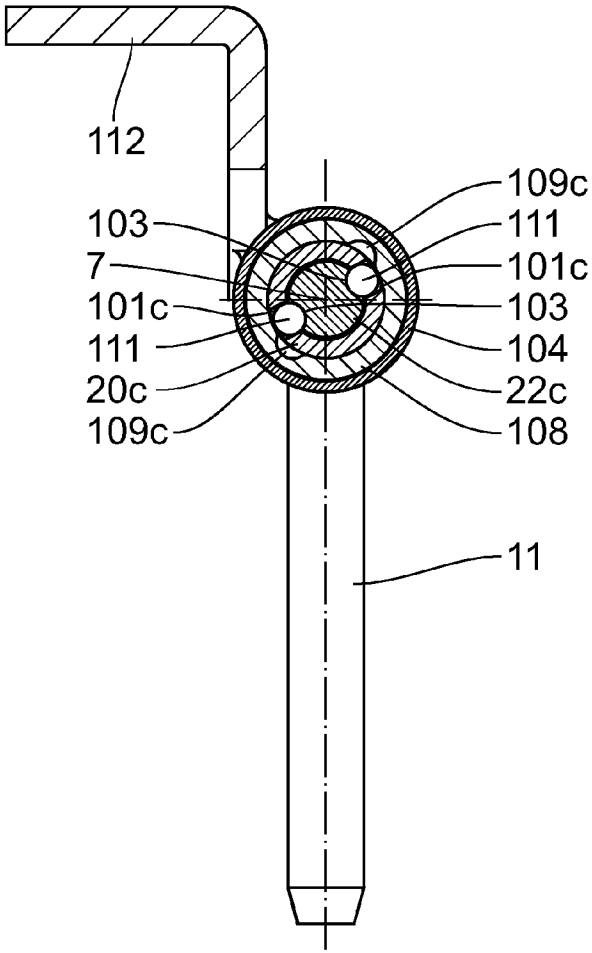
FIG. 44 is a cross-sectional view along the line XLIV-XLIV in FIG. 43.
Figure 46:
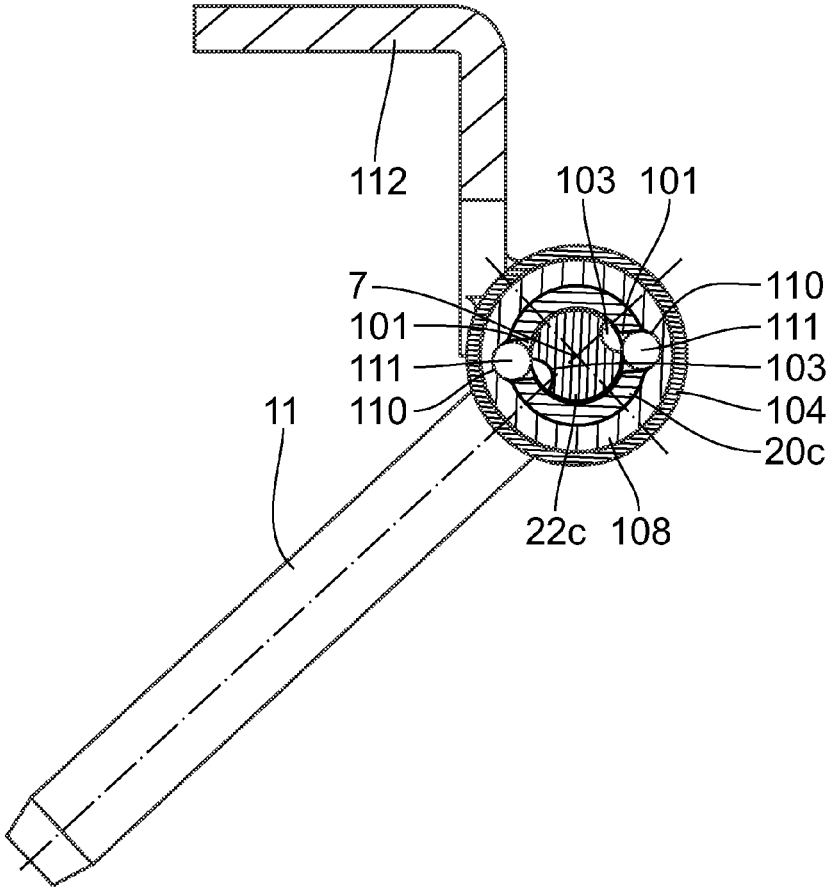
FIG. 46 is a sectional view, corresponding to FIG. 44, of the closing hinge in another rotating arrangement.
Figure 47:
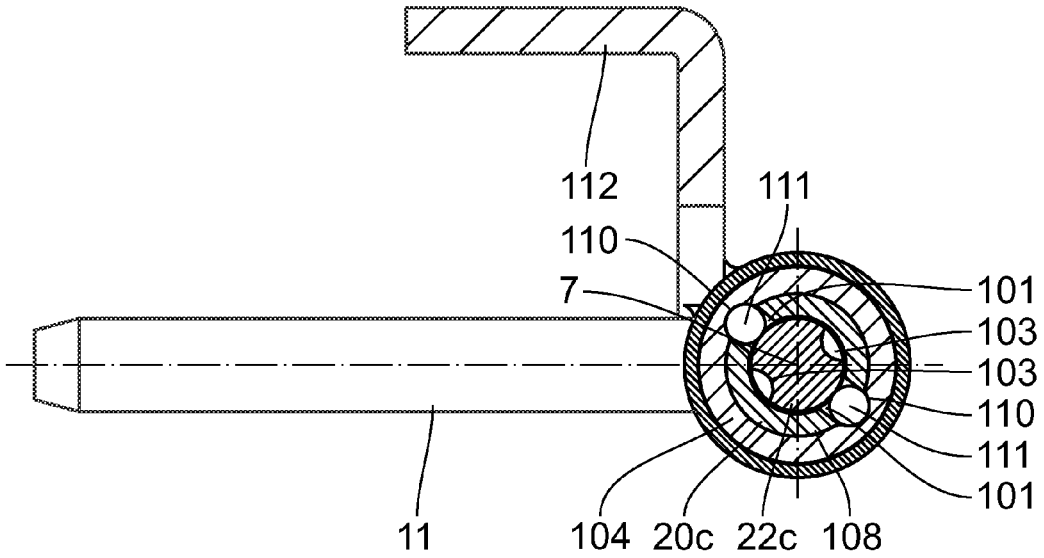
FIG. 47 is a sectional view, corresponding to FIG. 44, of the closing hinge in yet another rotating arrangement.

The mode of functioning of a door arrangement 1*a* with the closing hinge 5*b* and the damping hinge 6*a* will be described below with the aid of FIGS. 41 and 42. A plan view of the door arrangement 1*a* is shown schematically in FIG. 41 with the door leaf 2, which rests on the door frame 3 in a closing manner and is pivotably mounted on the door frame 3 about the pivot axis 4. According to the view in FIG. 41, the door arrangement 1*a* is shown in a closed position, i.e. the door leaf 2 rests on the door frame 3 in a closing manner.

Proceeding from this closed position, the door arrangement 1*a* can be transferred into an opened position. According to the embodiment shown, a maximum pivoting angle a of at least 180° is possible here. It is advantageous if the maximum pivoting angle a is at least 110° and, in particular, at least 135°. Furthermore, entered in FIG. 41 are a first closing angle $b_1$, which is arranged at a pivoting angle position of about 45°, a second closing angle $b_2$, which is arranged at a pivoting angle position of about 5°, and a damping angle c, which is arranged at a pivoting angle position of about 22°.

It may also be advantageous to select the damping angle c to be larger than the first closing angle $b_1$. In this case, on closing the door arrangement 1*a*, the damping function starts before the closing function, which is also called a pulling to function. In particular, the damping angle c should, however, be selected to be greater than the second closing angle $b_2$, so that the last portion of a closing movement of the door arrangement 1*a* takes place in a damped manner in every case.

Accordingly, a greater angle range is available for the damping of a slamming door leaf. The damping torque is comparatively small.

If the door leaf 2 is in a pivoting angle range of greater than 45°, in other words greater than the first closing angle $b_1$, the closing hinge 5*b* is in the freely rotating arrangement, i.e. the door leaf 2 can be pivoted in relation to the door frame 3 without torque loading by a closing torque.

When the door leaf 2 is pivoted toward the door frame 3 and the first closing angle $b_1$ has been reached, the closing function of the closing hinge 5*b* is activated as described above and the door leaf 2 is automatically drawn toward the door frame 3 with a first closing force.

As soon as the pivoting angle a, which continuously reduces in the closing arrangement of the closing hinge 5*b*, reaches the damping angle c, the damping function of the damping hinge 6*a* is activated, so the closing movement brought about by the closing hinge 5*b* is damped by the damping hinge 6*a*.

As soon as the pivoting angle a reaches the second closing angle $b_2$, the second torsion spring of the closing hinge 5*b* is activated and an additional closing torque is exerted on the door leaf 2. The closing movement of the door arrangement 1*a* takes place automatically and in a damped manner overall. An inadvertent slamming of the door is prevented.

It is furthermore guaranteed that the door arrangement 1*a*, in particular in the case of larger pivoting angles, can be pivoted free of torque. An actuation of this type is possible in a smooth manner.

In order to actuate the door arrangement 1 from the closed position, i.e. to open the door leaf 2, an initial closing torque $M_{SA}$ firstly has to be overcome. The initial closing torque $M_{SA}$ is composed of the closing torques of the first and the second torsion springs of the closing hinge 5*b* and the damping hinge 6*a*. On reaching the second closing angle $b_2$, the second torsion spring is deactivated, so the latter no longer causes any closing torque. The closing torque $M_S$ reduces abruptly. The closing torque increases until the damping angle c is reached. Then, in other words, with the increasing opening angle, the closing torque reduces as a result of the damping. The damping piston 69 can also be configured in such a way that the damping function only acts in a one-sided manner, in particular when closing the door leaf 2. This means that on opening the door leaf 2, no additional damping torque caused by the damping hinge 6 has to be overcome. Accordingly, the closing torque in the angle range between the second closing angle $b_2$ and the damping angle c can have a horizontal course.

A fourth embodiment of a closing hinge will be described below with reference to FIGS. 43 to 47. Structurally identical parts receive the same reference numerals as in the first three embodiments, to the description of which reference is hereby made. Structurally different, but functionally similar parts receive the same reference numerals with a "c" placed thereafter.

The closing hinge 5*c* according to the fourth embodiment substantially corresponds to the closing hinge 5*b* according to the third embodiment. The essential difference is that the closing hinge 5*c* has only one coupling element 20*c*, in which the elongate holes 101*c* are provided. The elongate holes 101*c* extend along the center longitudinal axis 7 in particular without a rotation angle offset. Accordingly, the elongate hole grooves 109*c* of the rotating sleeve 108 are also arranged in an aligned manner.

The closing hinge 5*c* allows a simultaneous actuation of the two torsion springs 97 and 33.

Figure 48:
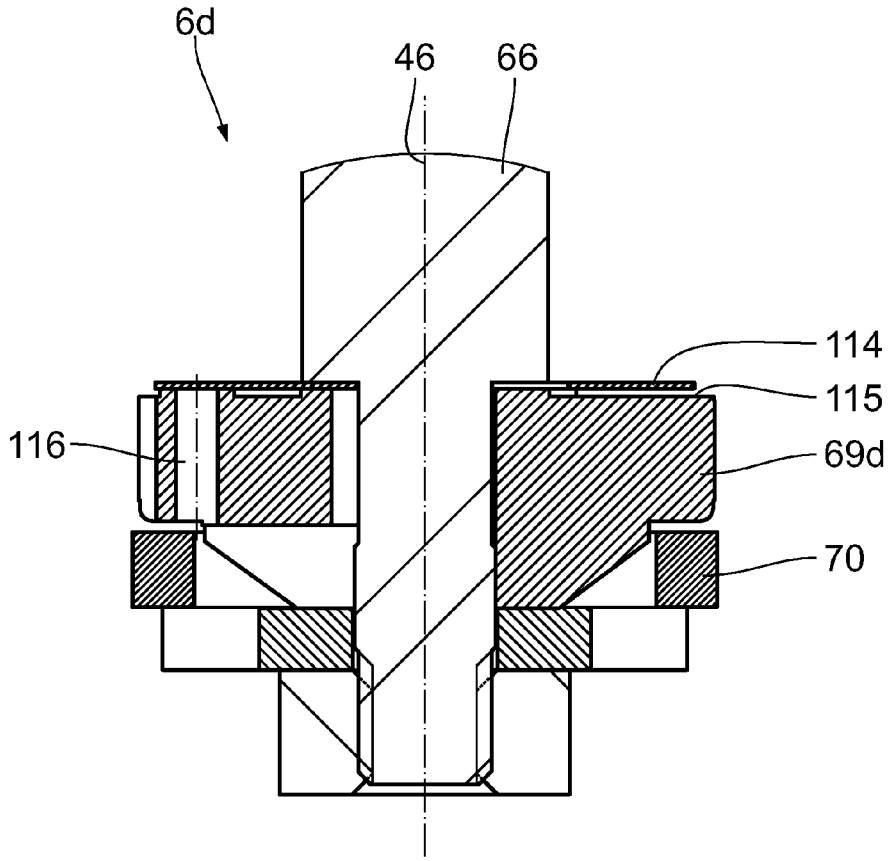
FIG. 48 is an enlarged detailed view, corresponding to FIG. 11, of a damping hinge with an overload protection mechanism.

A fifth embodiment of a damping hinge will be described below with reference to FIG. 48. Structurally identical parts receive the same reference numerals as in the first three embodiments, to the description of which reference is hereby made. Structurally different, but functionally similar parts receive the same reference numerals with a "d" placed thereafter.

The essential difference of the damping hinge 6*d* is that it has an overload protection mechanism. Because of the dynamic flow properties of the damping fluid, the damping effect increases with the increasing closing speed of the door. This means that a decelerating damping torque caused by the damping unit 71 and counteracting the closing movement of the door increases with an increasing closing speed. In order to avoid damage to the damping hinge 6*d*, in particular as a result of an excess damping torque, an overload protection mechanism is provided.

The overload protection mechanism is ensured by a spring disc 114. The spring disc 114 is arranged on an upper end face 115 of the damping piston 69*d* remote from the ring seal 70. The spring disc is held between the damping piston 69*d* and a shoulder of the piston rod 66 in the axial direction of the rotational axis 46. In the arrangement shown in FIG. 48, in which the overload protection mechanism is not active, the spring disc 114 rests substantially flat on the end face 115. As a result, a through-bore 116 arranged parallel to the rotational axis 46 is covered by the spring disc. It is also possible for the spring disc 114 to simultaneously cover a plurality of through-bores 116. In this arrangement it is not possible for the damping fluid to flow through the through-bore 116 upon a closing movement of the door.

On closing the door at a high speed, the pressure of the damping fluid increases in the damping cylinder 72. The spring disc 114 is designed in such a way that as soon as an adjusted critical pressure has been reached in the damping cylinder 72, the spring disc lifts from the through-bore 114 and frees the latter for the damping fluid. The through-bore in the arrangement freed by the spring disc 114 acts as a bypass. The pressure in the damping cylinder 72 is reduced. In particular, the mechanical loading as a result of the damping torque is limited or reduced.

While specific embodiments of the invention have been shown and described in detail to illustrate the application of the principles of the invention, it will be understood that the invention may be embodied otherwise without departing from such principles.

What is claimed is:

1. A door arrangement, comprising:

a closing hinge and a damping hinge for pivotable articulation of a first part on a second part, said damping hinge comprising:

a first housing part fastened to the first part;

a second housing part fastened to the second part;

a damping unit for providing a damping function for the door arrangement;

an opening limitation, wherein said opening limitation is defined by a maximally possible opening angle, the closing hinge comprising:

a center longitudinal axis;

a rotating receiver unit that is rotatable about the center longitudinal axis for fastening to the first part that is rotatable;

a freely rotating closing unit, which is connected to the rotating receiver unit in a torque-transmitting manner, for fastening to the second part, which is fixed, wherein the closing hinge is displaceable between a closing arrangement and a freely rotating arrangement, wherein, in the closing arrangement, the freely rotating closing unit brings about a closing torque on the rotating receiver unit in a closing rotational direction about the center longitudinal axis, and wherein, in the freely rotating arrangement, the rotating receiver unit is rotatable in a torque-free manner relative to the freely rotating closing unit about the center longitudinal axis.

2. A door arrangement according to claim 1, wherein the rotating receiver unit has a rotating receiver element for torque-transmitting connection to the freely rotating closing unit.

3. A door arrangement according to claim 2, wherein a coupling element and the rotating receiver element are arranged in a torque-transmitting manner with respect to the center longitudinal axis and axially displaceably with respect to one another.

4. A door arrangement according to claim 2, wherein a coupling element and the rotating receiver element are non-rotatably axially displaceably with respect to one another, wherein said coupling element comprises a coupling element end face profile, to which corresponds a rotating receiver element end face profile of the rotating receiver element.

5. A door arrangement according to claim 1, wherein the freely rotating closing unit has a rotating drive element connected in a torque-transmitting manner to the rotating receiver unit with respect to the center longitudinal axis.

6. A door arrangement according to claim 5, wherein the closing hinge further comprises a coupling element for connecting the rotating drive element to a tensioning unit in a torque-free manner about the center longitudinal axis.

7. A door arrangement according to claim 1, wherein the freely rotating closing unit has a tensioning unit for applying the closing torque to the rotating receiver unit, the freely rotating closing unit further comprising a coupling element for connecting the rotating drive element to a tensioning unit in one of a torque transmitting manner and freely rotatably about the center longitudinal axis.

8. A door arrangement according to claim 7, wherein the coupling element and the tensioning unit are arranged in a torque-transmitting manner with respect to the center longitudinal axis and axially displaceably with respect to one another.

9. A door arrangement according to claim 7, wherein the tensioning unit has a tensioning element arranged between a base plate and a closing drive element that is rotatable about the center longitudinal axis.

10. A door arrangement according to claim 7, wherein a coupling element and the tensioning element are arranged axially displaceably with respect to one another by means of a profile guide with a guiding element having a non-round cross sectional profile perpendicular to the center longitudinal axis.

11. A door arrangement according to claim 1, the closing hinge further comprises a parking element, which is non-rotatable with respect to the center longitudinal axis, to receive the closing torque in the freely rotating arrangement.

12. A door arrangement according to claim 1, wherein the closing torque acting with respect to the center longitudinal axis is adjustable.

13. A door arrangement according to claim 1, wherein a transition from the closing arrangement into the freely rotating arrangement is adjustable.

14. A door arrangement according to claim 1, the closing hinge further comprises a closing hinge housing upper part, in which the rotating receiver unit is arranged.

15. A door arrangement according to claim 14, wherein a closing hinge housing lower part and the closing hinge housing upper part are arranged concentrically with respect to the center longitudinal axis and said closing hinge housing lower part and said closing hinge housing upper part are pivotable relative to one another about the center longitudinal axis.

16. A door arrangement according to claim 1, wherein the closing hinge further comprises a closing hinge housing lower part, in which the freely rotating closing unit is arranged.

17. A door arrangement according to claim 1, the closing hinge further comprises a further freely rotating closing unit.

18. A door arrangement according to claim 1, wherein said first part is a door leaf.

19. A door arrangement according to claim 1, wherein said second part is a door frame.

20. A door arrangement according to claim 1, wherein said first part is rotatable about the center longitudinal axis.

21. A door arrangement according to claim 1, wherein said second part is fixed with respect to the center longitudinal axis.

22. A door arrangement according to claim 1, wherein said rotating receiver unit is rotatable in a torque-free manner, relative to said freely rotating closing unit about said center longitudinal axis.

23. A door arrangement according to claim 1, wherein said tensioning element is a torsion spring, said opening limitation comprising a stop element.

24. A door arrangement according to claim 23, wherein the closing hinge further comprises a parking element, which is non-rotatable with respect to the center longitudinal axis, to receive the closing torque in the freely rotating arrangement by a non-rotatable arrangement of a coupling element on the parking element, said stop element protruding in an axial direction of a rotational axis in an end phase of an axial element.

25. A door arrangement according to claim 24, wherein said parking element is arranged coaxially with respect to the center longitudinal axis between the coupling element and a tensioning unit, said stop element engaging an 0-ring, wherein the O-ring is arranged in a cover, said stop engaging said cover.

26. A door arrangement according to claim 25, wherein:

a transition from the closing arrangement into the freely rotating arrangement is adjustable by fixing a closing angle about the center longitudinal axis of the rotating receiver unit relative to the freely rotating closing unit;

a maximally possible opening angle is adjusted by an axial protrusion of said stop element along the rotational axis;

said stop element is connected in a recess of the axial element.

27. A door arrangement according to claim 26, wherein said closing hinge is a hinge for fastening the closing hinge housing lower part to a door frame and the closing hinge housing upper part to a door leaf, said stop element being formed of plastic material.

28. A door arrangement, comprising:

a closing hinge and a damping hinge for pivotable articulation of a first part on a second part, said damping hinge comprising:

a first housing part fastened to the first part;

a second housing part fastened to the second part;

a damping unit for providing a damping function for the door arrangement;

an opening limitation, wherein said opening limitation is defined by a maximally possible opening angle, the closing hinge comprising:

a center longitudinal axis;

a rotating receiver unit that is rotatable about the center longitudinal axis for fastening to the first part that is rotatable;

a freely rotating closing unit, which is connected to the rotating receiver unit in a torque-transmitting manner, for fastening to the second part, which is fixed, wherein the closing hinge is displaceable between a closing arrangement and a freely rotating arrangement, wherein, in the closing arrangement, the freely rotating closing unit brings about a closing torque on the rotating receiver unit in a closing rotational direction about the center longitudinal axis, and wherein, in the freely rotating arrangement, the rotating receiver unit is rotatable in a torque-free manner relative to the freely rotating closing unit about the center longitudinal axis, and wherein, in the freely rotating arrangement, the rotating receiver unit is rotatable in a torque-free manner relative to the freely rotating closing unit about the center longitudinal axis, wherein said maximally possible opening angle is adjustable by an axial protrusion of a stop element along the longitudinal axis on an end face.

29. A door arrangement, comprising:

a closing hinge and a damping hinge for pivotable articulation of a first part on a second part, said damping hinge comprising:

a first housing part fastened to the first part;

a second housing part fastened to the second part;

a damping unit for providing a damping function for the door arrangement;

an opening limitation, wherein said opening limitation is defined by a maximally possible opening angle, the closing hinge comprising:

a center longitudinal axis;

a rotating receiver unit that is rotatable about the center longitudinal axis for fastening to the first part that is rotatable;

a freely rotating closing unit, which is connected to the rotating receiver unit in a torque-transmitting manner, for fastening to the second part, which is fixed, wherein the closing hinge is displaceable between a closing arrangement and a freely rotating arrangement, wherein, in the closing arrangement, the freely rotating closing unit brings about a closing torque on the rotating receiver unit in a closing rotational direction about the center longitudinal axis, and wherein, in the freely rotating arrangement, the rotating receiver unit is rotatable in a torque-free manner relative to the freely rotating closing unit about the center longitudinal axis, and wherein, in the freely rotating arrangement, the rotating receiver unit is rotatable in a torque-free manner relative to the freely rotating closing unit about the center longitudinal axis, wherein a transition from the closing arrangement into the freely rotating arrangement is adjustable by fixing a closing angle about the center longitudinal axis of the rotating receiver unit relative to the freely rotating closing unit.

* * * * *